US010073366B2

(12) United States Patent
Nagata et al.

(10) Patent No.: US 10,073,366 B2
(45) Date of Patent: Sep. 11, 2018

(54) TONER, TONER STORAGE UNIT, IMAGE FORMING APPARATUS, AND METHOD FOR MANUFACTURING TONER

(71) Applicants: Kohsuke Nagata, Shizuoka (JP); Ryuuta Yoshida, Kanagawa (JP); Shinya Nakayama, Shizuoka (JP); Tsuyoshi Sugimoto, Kanagawa (JP); Akinori Saitoh, Shizuoka (JP); Hideyuki Santo, Kanagawa (JP); Suzuka Karato, Shizuoka (JP); Koh Ohnuma, Shizuoka (JP); Takahiro Kadota, Shizuoka (JP); Shinsuke Nagai, Shizuoka (JP); Akihiro Takeyama, Kanagawa (JP)

(72) Inventors: Kohsuke Nagata, Shizuoka (JP); Ryuuta Yoshida, Kanagawa (JP); Shinya Nakayama, Shizuoka (JP); Tsuyoshi Sugimoto, Kanagawa (JP); Akinori Saitoh, Shizuoka (JP); Hideyuki Santo, Kanagawa (JP); Suzuka Karato, Shizuoka (JP); Koh Ohnuma, Shizuoka (JP); Takahiro Kadota, Shizuoka (JP); Shinsuke Nagai, Shizuoka (JP); Akihiro Takeyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/622,755

(22) Filed: Jun. 14, 2017

(65) Prior Publication Data

US 2017/0363980 A1 Dec. 21, 2017

(30) Foreign Application Priority Data

Jun. 15, 2016 (JP) ..... 2016-119292
Jun. 5, 2017 (JP) ..... 2017-110816

(51) Int. Cl.
*G03G 9/08* (2006.01)
*G03G 9/087* (2006.01)
(Continued)

(52) U.S. Cl.
CPC ..... *G03G 9/08708* (2013.01); *G03G 9/0804* (2013.01); *G03G 9/0815* (2013.01);
(Continued)

(58) Field of Classification Search
CPC ..... G03G 9/0825; G03G 9/08708; G03G 9/08755
(Continued)

(56) References Cited

U.S. PATENT DOCUMENTS

2011/0151368 A1* 6/2011 Hong ..... G03G 9/0819 430/108.8
2012/0052434 A1 3/2012 Sugimoto et al.
2015/0362852 A1* 12/2015 Moriya ..... G03G 9/08755 430/109.4

FOREIGN PATENT DOCUMENTS

JP 63-109447 5/1988
JP 11-133665 5/1999
(Continued)

OTHER PUBLICATIONS

Imoto Minoru, "Basic Theory of Gluing, Macromolecule Publication Meeting" pp. 89-103 ( with Partial English translation).

*Primary Examiner* — Mark A Chapman
(74) *Attorney, Agent, or Firm* — Oblon, McClelland, Maier & Neustadt, L.L.P.

(57) ABSTRACT

A toner is provided. The toner includes an amorphous resin, a crystalline resin dispersed in the amorphous resin, and a release agent. The toner satisfies the following inequality:

$B/A<0.8$ (Continued)

where A represents a perimeter of the crystalline resin and B represents a length of a part of the perimeter A of the crystalline resin at which the crystalline resin is in contact with the amorphous resin, A and B being measured from a cross-sectional image of the toner observed with transmission electron microscope.

12 Claims, 3 Drawing Sheets

(51) Int. Cl.
*G03G 9/09* (2006.01)
*G03G 15/08* (2006.01)

(52) U.S. Cl.
CPC ..... *G03G 9/0825* (2013.01); *G03G 9/08755* (2013.01); *G03G 9/0904* (2013.01); *G03G 15/0865* (2013.01)

(58) Field of Classification Search
USPC ..... 430/109.3, 109.4, 110.1
See application file for complete search history.

(56) References Cited

FOREIGN PATENT DOCUMENTS

| | | |
|---|---|---|
| JP | 2001-158819 | 6/2001 |
| JP | 2002-287400 | 10/2002 |
| JP | 2002-351143 | 12/2002 |
| JP | 2004-046095 | 2/2004 |
| JP | 2007-271789 | 10/2007 |
| JP | 2012-053196 | 3/2012 |

* cited by examiner

TONER, TONER STORAGE UNIT, IMAGE FORMING APPARATUS, AND METHOD FOR MANUFACTURING TONER

CROSS-REFERENCE TO RELATED APPLICATIONS

This patent application is based on and claims priority pursuant to 35 U.S.C. § 119(a) to Japanese Patent Application Nos. 2016-119292 and 2017-110816, filed on Jun. 15, 2016 and Jun. 5, 2017, in the Japan Patent Office, the entire disclosure of each of which is hereby incorporated by reference herein.

BACKGROUND

Technical Field

The present disclosure relates to a toner, a toner storage unit, an image forming apparatus, and a method for manufacturing toner.

Description of the Related Art

Recently, toner has been required to be much smaller in particle size for higher image quality, to be fixable at much lower temperatures for energy saving, and to have heat-resistant storage stability so as to be resistant to high temperatures and high humidities when stored or transported. In an image forming process, most of the consumed energy is used for fixing toner on a recording medium. Thus, it is effective in terms of energy saving to improve toner to be fixable at much lower temperatures.

Conventionally, toners produced by kneading and pulverization processes (hereinafter "pulverization toners") have been used widely. However, pulverization toners have some drawbacks. Firstly, it is difficult to produce pulverization toners having a small particle size. Secondly, the output image quality is insufficient because the shape is irregular and the particle size distribution is broad. Thirdly, a high fixing energy is required. In a case in which a pulverization toner includes a wax (release agent) for improving fixability, the wax is exposed in large amounts at the surface of the toner, because the kneaded mixture of raw materials cracks at the interface between the wax and other materials in the pulverization process. The exposed wax exerts a releasing effect. At the same time, disadvantageously, the exposed wax is likely to adhere to carrier particles, photoconductors, and/or blades (this phenomenon may be hereinafter referred to as "filming"). Thus, it is said that total performance of pulverization toners is insufficient.

SUMMARY

In accordance with some embodiments of the present invention, a toner is provided. The toner includes an amorphous resin, a crystalline resin dispersed in the amorphous resin, and a release agent. The toner satisfies the following inequality:

$$B/A<0.8$$

where A represents a perimeter of the crystalline resin and B represents a length of a part of the perimeter A of the crystalline resin at which the crystalline resin is in contact with the amorphous resin, A and B being measured from a cross-sectional image of the toner observed with transmission electron microscope.

In accordance with some embodiments of the present invention, a toner storage unit is provided. The toner storage unit includes a storage unit and the above toner stored in the storage unit.

In accordance with some embodiments of the present invention, an image forming apparatus is provided. The image forming apparatus includes an electrostatic latent image bearer, an electrostatic latent image forming device, and a developing device. The electrostatic latent image forming device forms an electrostatic latent image on the electrostatic latent image bearer. The developing device includes the above toner to develop the electrostatic latent image formed on the electrostatic latent image bearer into a visible image with the toner.

In accordance with some embodiments of the present invention, a method for manufacturing the above toner is provided. The method includes the processes of: dissolving the crystalline resin and the release agent in an organic solvent by application of heat to prepare a solution; and cooling the solution to prepare a dispersion liquid of a composite particle in which the crystalline resin and the release agent are partially combined by recrystallizing the crystalline resin and the release agent. The release agent has a crystallization temperature higher than the crystalline resin by 20° C. or more.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
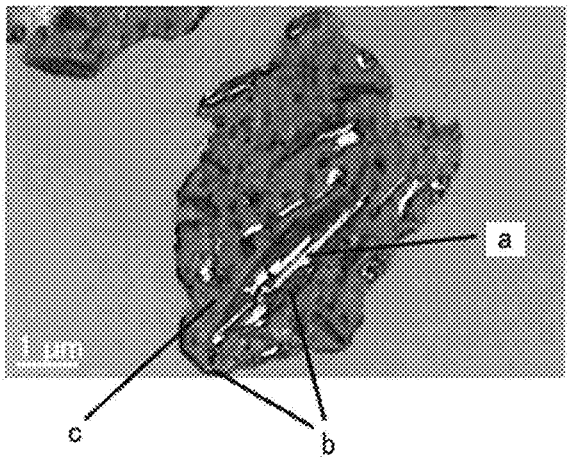
FIG. 1 is a cross-sectional view of a toner according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In attempting to overcome the-above-described drawbacks of pulverization toners, toners produced by polymerization processes (hereinafter "polymerization toners") have been proposed. It is generally easy for polymerization processes to produce a toner having a smaller particle size and a narrower particle size distribution compared to pulverization processes, and furthermore, to encapsulate a release agent in the toner.

For example, one proposed polymerization toner includes a crystalline polyester resin and a release agent that are incompatible with each other. The resin and the release agent form a sea-island phase separation structure in the toner.

Another proposed polymerization toner includes a crystalline polyester resin, a release agent, and a graft polymer.

These toners may provide low-temperature fixability since the crystalline polyester resin more rapidly melts than amorphous polyester resins.

However, as the crystalline polyester resin (forming island portions in the sea-island structure) and an amorphous polyester resin (forming sea portions in the sea-island structure) are in contact with each other, mechanical strength of the toner is degraded at the contact portions. When such a toner is highly stressed, for example in a high-speed developing device, it is likely that the toner particles are aggregated, external additives are embedded in the toner particles, and carrier particles are contaminated with the toner particles. As a result, the charging ability of the toner may deteriorate with time and toner filming may occur on a photoconductor, causing abnormal images. Moreover, such toners achieve neither a high level of low-temperature fixability nor image quality.

Accordingly, the inventors of the present invention provide a toner that is excellent in heat-resistant storage stability and mechanical strength while maintaining low-temperature fixability.

Toner

The toner according to an embodiment of the present invention includes at least an amorphous resin, a crystalline resin, and a release agent. The crystalline resin is dispersed in the amorphous resin.

The toner satisfies an inequality $B/A<0.8$, where A represents a perimeter of the crystalline resin and B represents a length of a part of the perimeter A of the crystalline resin at which the crystalline resin is in contact with the amorphous resin. A and B are measured from a cross-section of the toner observed with transmission electron microscope.

When B/A is 0.8 or more, the crystalline resin and the amorphous resin are partially compatibilized at the contact portion therebetween, thus degrading mechanical strength of the toner. When such a toner is highly stressed, for example in a high-speed developing device, it is likely that the toner particles are aggregated, external additives are embedded in the toner particles, and carrier particles are contaminated with the toner particles. As a result, the charging ability of the toner may deteriorate with time and toner filming may occur on a photoconductor, causing abnormal images.

To adjust B/A to be within the above range, it is preferable that the crystalline resin and the release agent are recrystallized in the toner manufacturing process and combined into a partially-composite body. It is more preferable that the crystalline resin and the release agent is combined into a composite body first, and thereafter the composite body is mixed with the amorphous resin, rather than merely mixing the crystalline resin, the amorphous resin, and the release agent, so that the composite body of the crystalline resin and the release agent is dispersed in the amorphous resin. The toner manufacturing method is described in detail later.

TEM Observation of Toner

As described above, the toner satisfies the inequality $B/A<0.8$, where A represents a perimeter of the crystalline resin and B represents a length of a part of the perimeter A of the crystalline resin at which the crystalline resin is in contact with the amorphous resin. A and B are measured from a cross-section of the toner observed with transmission electron microscope (TEM).

Preferably, B/A is in the range of from 0.15 to 0.79.

More preferably, B/A is in the range of from 0.5 to 0.6, to achieve a good balance between low-temperature fixability and mechanical strength.

In addition, preferably, the toner further satisfies an inequality $0.05<D/C<0.4$, where C represents a perimeter of the toner and D represents a length of a part of the perimeter C of the toner at which the crystalline resin is exposed. C and D are measured from the cross-section of the toner observed with transmission electron microscope.

When D/C is greater than 0.05, deterioration of low-temperature fixability can be effectively prevented because the crystalline resin exposed at the surface of the toner can sufficiently lower its melt viscosity when being fixed on a recording medium, such as a paper sheet, and can be sufficiently fixed thereon. When D/C is less than 0.4, generation of abnormal image can be effectively prevented because the crystalline resin and the amorphous resin may not be partially compatibilized with each other at the surface of the toner, thereby not degrading mechanical strength of the surface of the toner and not generating toner aggregation in a developing device.

TEM Observation Method for Toner

The cross-section of the toner is dyed with ruthenium and thereafter observed with a transmission electron microscope (TEM). The obtained image is analyzed to determine the above-described parameters A, B, C, and D. The contact ratio (B/A) of the crystalline resin to the amorphous resin and the exposure ratio (D/C) of the crystalline resin at the surface of the toner are calculated based on A, B, C, and D.

The toner can be dyed with ruthenium in the following manner, but the dying method is not limited thereto. First, the toner is embedded in an epoxy resin and cut into a section having a thickness of 100 nm using a microtome. This section is dyed with a 0.5% aqueous solution of ruthenium tetraoxide. The dyed section is observed with a TEM to confirm a structure in which the crystalline resin is in contact with the release agent. As illustrated in FIG. 1, the crystalline resin and the release agent can be distinguished from the toner by their contrasts and shapes. In FIG. 1, the release agent, the crystalline resin, and the amorphous resin are represented by symbols a, b, and c, respectively. Specifically, the white stick-like or line-like parts can be determined to be the release agent, and the most-densely-dyed stick-like or line-like parts can be determined to be the crystalline resin.

The obtained image is analyzed as follows using an image analysis software program "Image J".

For each of 50 randomly-selected toner particles, the total perimeters A of the crystalline resin, the total lengths B of the parts of the perimeter A of the crystalline resin at which the crystalline resin is in contact with the amorphous resin, the perimeter C of the toner, and the total lengths D of the parts of the perimeter C of the toner at which the crystalline resin is exposed at the surface of the toner are determined by designating each portion in the cross-sectional image of the toner, to calculate B/A and D/C, and the measured B/A and D/C values for each toner particle are averaged.

Toner Constituents

The toner includes a binder resin including the amorphous resin and the crystalline resin, and further includes the release agent. The toner may optionally include other constituents such as a colorant.

Preferably, the binder resin includes two or more types of amorphous resins. Preferably, the amorphous resin and the crystalline resin are polyester-based resins, such as an amorphous polyester resin and a crystalline polyester resin, respectively. Preferably, the binder resin further includes, in addition to an amorphous polyester resin A that is typically used for toners and the crystalline polyester resin, another amorphous polyester resin B (different from the amorphous polyester resin A) and/or an amorphous hybrid resin.

Amorphous Polyester Resin A

The amorphous polyester resin A has a backbone derived from an alcohol component and another backbone derived from a carboxylic acid component.

Preferably, the amorphous polyester resin A is produced by reacting an alcohol component including an aliphatic alcohol having 3 or more valences with a carboxylic acid component. By this procedure, a polyester resin having a branched structure is obtained.

Alcohol Component

Examples of the alcohol component include, but are not limited to, divalent alcohols and alcohols having 3 or more valences.

Preferably, the alcohol component includes an aliphatic alcohol having 3 or more valences.

Specific examples of the divalent alcohols include, but are not limited to, aliphatic diols, diols having oxyalkylene group, alicyclic diols, alkylene oxide (e.g., ethylene oxide, propylene oxide, butylene oxide) adducts of alicyclic diols, bisphenols, and alkylene oxide adducts of bisphenols.

Specific examples of the aliphatic diols include, but are not limited to, ethylene glycol, 1,2-propylene glycol, 1,3-propylene glycol, 1,4-butanediol, 3-methyl-1,5-pentanediol, 1,6-hexanediol, 1,8-octanediol, 1,10-decanediol, and 1,12-dodecanediol.

Specific examples of the diols having oxyalkylene group include, but are not limited to, diethylene glycol, triethylene glycol, dipropylene glycol, polyethylene glycol, polypropylene glycol, and polytetramethylene glycol.

Specific examples of the alicyclic diols include, but are not limited to, 1,4-cyclohexanedimethanol and hydrogenated bisphenol A.

Specific examples of the bisphenols include, but are not limited to, bisphenol A, bisphenol F, and bisphenol S.

Specific examples of the alkylene oxide adducts of bisphenols include, but are not limited to, bisphenols to which an alkylene oxide, such as ethylene oxide, propylene oxide, and butylene oxide, is adducted.

Specific examples of the alcohols having 3 or more valences include, but are not limited to, aliphatic alcohols having 3 or more valences.

Specific examples of the aliphatic alcohols having 3 or more valences include, but are not limited to, glycerin, trimethylolethane, trimethylolpropane, pentaerythritol, sorbitol, and dipentaerythritol.

Preferably, the aliphatic alcohols having 3 or more valences have 3 or 4 valences.

Carboxylic Acid Component

Examples of the carboxylic acid component include, but are not limited to, divalent carboxylic acids and carboxylic acids having 3 or more valences. In addition, anhydrides, lower alkyl esters (C1-C3), and halides thereof may also be used.

Specific examples of the divalent carboxylic acids include, but are not limited to, aliphatic dicarboxylic acids and aromatic dicarboxylic acids.

Specific examples of the aliphatic dicarboxylic acids include, but are not limited to, succinic acid, adipic acid, sebacic acid, dodecanedioic acid, maleic acid, and fumaric acid.

Specific examples of the aromatic dicarboxylic acids include, but are not limited to, phthalic acid, isophthalic acid, terephthalic acid, and naphthalene dicarboxylic acids.

Specific examples of the carboxylic acids having 3 or more valences include, but are not limited to, trimellitic acid and pyromellitic acid.

Each of these compounds can be used alone or in combination with others.

Preferably, the content of the amorphous polyester resin A in 100 parts by mass of the toner is in the range of from 50 to 95 parts by mass, more preferably from 70 to 90 parts by mass.

Amorphous Polyester Resin B

Preferably, the amorphous resin in the binder resin further includes the amorphous polyester resin B different from the amorphous polyester resin A.

The amorphous polyester resin B is not limited so long as it is different from the amorphous polyester resin A.

The amorphous polyester resin B may include a diol component alone or both a diol component and a cross-linked component. Preferably, the amorphous polyester resin B further includes a dicarboxylic acid component.

Preferably, the diol component includes an aliphatic diol having 3 to 10 carbon atoms in an amount of 50% by mol or more.

Preferably, the cross-linked component includes at least one of a carboxylic acid having 3 or more valences or an alcohol having 3 or more valences. More preferably, the cross-linked component includes an alcohol having 3 or more valences, and more preferably an aliphatic alcohol having 3 or more valences.

Preferably, the amorphous polyester resin B has urethane bond and/or urea bond for expressing improved adhesion property to recording media such as paper. More preferably, the amorphous polyester resin B includes both urethane bond and urea bond. When included in the amorphous polyester resin B, urethane bond and/or urea bond behave as pseudo branch points, thereby enhancing rubber property of the amorphous polyester resin B. Thus, the toner can be improved in heat-resistant storage stability and high-temperature offset resistance.

Reactive Precursor

Preferably, the amorphous polyester resin B is obtained by reacting a reactive precursor with a curing agent.

The reactive precursor is not limited to any particular material so long as it is a polyester resin having a group reactive with the curing agent (hereinafter "prepolymer").

Examples of the group reactive with the curing agent include, but are not limited to, a group reactive with an active hydrogen group. Specific examples of the group reactive with an active hydrogen group include, but are not limited to, isocyanate group, epoxy group, carboxylic acid group, and an acid chloride group. Among these groups, isocyanate group is preferable because urethane bond and/or urea bond can be introduced to the amorphous polyester resin B.

Preferably, the prepolymer is non-linear. Being non-linear here refers to having a branched structure formed with at least one of an alcohol having 3 or more valences and a carboxylic acid having 3 or more valences.

Preferably, the prepolymer is a polyester resin having an isocyanate group.

Polyester Resin Having Isocyanate Group

Examples of the polyester resin having an isocyanate group include, but are not limited to, a reaction product of a polyester resin having an active hydrogen group with a polyisocyanate. The polyester resin having an active hydrogen group may be obtained by a polycondensation among at least two of a diol component, a dicarboxylic acid component, an alcohol having 3 or more valences, and a carboxylic acid having 3 or more valences. The alcohol having 3 or more valences and the carboxylic acid having 3 or more valences impart a branched structure to the resultant polyester resin having an isocyanate group.

Diol Component

Specific examples of the diol component include, but are not limited to, aliphatic diols, diols having oxyalkylene group, alicyclic diols, alkylene oxide (e.g., ethylene oxide, propylene oxide, butylene oxide) adducts of alicyclic diols, bisphenols, and alkylene oxide adducts of bisphenols.

Specific examples of the aliphatic diols include, but are not limited to, ethylene glycol, 1,2-propylene glycol, 1,3-propylene glycol, 1,4-butanediol, 3-methyl-1,5-pentanediol, 1,6-hexanediol, 1,8-octanediol, 1,10-decanediol, and 1,12-dodecanediol.

Specific examples of the diols having oxyalkylene group include, but are not limited to, diethylene glycol, triethylene glycol, dipropylene glycol, polyethylene glycol, polypropylene glycol, and polytetramethylene glycol.

Specific examples of the alicyclic diols include, but are not limited to, 1,4-cyclohexanedimethanol and hydrogenated bisphenol A.

Specific examples of the bisphenols include, but are not limited to, bisphenol A, bisphenol F, and bisphenol S.

Specific examples of the alkylene oxide adducts of bisphenols include, but are not limited to, bisphenols to which an alkylene oxide, such as ethylene oxide, propylene oxide, and butylene oxide, is adducted.

Dicarboxylic Acid Component

Specific examples of the dicarboxylic acids include, but are not limited to, aliphatic dicarboxylic acids and aromatic dicarboxylic acids. In addition, anhydrides, lower alkyl esters (C1-C3), and halides thereof may also be used.

Specific examples of the aliphatic dicarboxylic acids include, but are not limited to, succinic acid, adipic acid, sebacic acid, dodecanedioic acid, maleic acid, and fumaric acid.

Specific examples of the aromatic dicarboxylic acids include, but are not limited to, phthalic acid, isophthalic acid, terephthalic acid, and naphthalene dicarboxylic acids.

Alcohol Having 3 or More Valences

Specific examples of the alcohol having 3 or more valences include, but are not limited to, aliphatic alcohols having 3 or more valences.

Specific examples of the alcohol having 3 or more valences further include, but are not limited to, trivalent or tetravalent alcohols.

Preferably, the aliphatic alcohol having 3 or more valences is a trivalent or tetravalent alcohol, for improving low-temperature fixability, high-temperature-and-high-humidity-resistant storage stability, and stress resistance.

Specific examples of the trivalent or tetravalent alcohol include, but are not limited to, glycerin, trimethylolethane, trimethylolpropane, and pentaerythritol.

Carboxylic Acid Having 3 or More Valences

Specific examples of the carboxylic acid having 3 or more valences include, but are not limited to, trivalent or tetravalent carboxylic acids. Specific examples of the trivalent or tetravalent carboxylic acids include, but are not limited to, trimellitic acid and pyromellitic acid.

When the amorphous polyester resin B includes the carboxylic acid having 3 or more valences or the alcohol having 3 or more valences as constitutional components, rubber elasticity is expressed and blocking resistance is thereby improved. Since rubber elasticity is expressed while the resin maintains high thermal deformability within the fixing temperature range, the toner can be improved in low-temperature fixability and blocking resistance.

Among the trivalent or tetravalent carboxylic acids and the trivalent or tetravalent alcohols, trivalent or tetravalent aliphatic alcohols are preferable for improving low-temperature fixability.

Polyisocyanate

Specific examples of the polyisocyanate include, but are not limited to, diisocyanates and isocyanates having 3 or more valences.

Specific examples of the diisocyanates include, but are not limited to, aliphatic diisocyanates, alicyclic diisocyanates, aromatic diisocyanates, aromatic aliphatic diisocyanates, and isocyanurates, and these diisocyanates blocked with a phenol derivative, oxime, or caprolactam.

Specific examples of the aliphatic diisocyanates include, but are not limited to, tetramethylene diisocyanate, hexamethylene diisocyanate, methyl 2,6-diisocyanatocaproate, octamethylene diisocyanate, decamethine diisocyanate, dodecamethylene diisocyanate, tetradecamethylene diisocyanate, trimethylhexane diisocyanate, and tetramethylhexane diisocyanate.

Specific examples of the alicyclic diisocyanates include, but are not limited to, isophorone diisocyanate, cyclohexylmethane diisocyanate.

Specific examples of the aromatic diisocyanates include, but are not limited to, tolylene diisocyanate, diisocyanatodiphenylmethane, 1,5-naphthylene diisocyanate, 4,4'-diisocyanatodiphenyl, 4,4'-diisocyanato-3,3'-dimethyldiphenyl, 4,4'-diisocyanato-3-methyldiphenylmethane, and 4,4'-diisocyanato-diphenyl ether.

Specific examples of the aromatic aliphatic diisocyanates include, but are not limited to, $\alpha,\alpha,\alpha',\alpha'$-tetramethylxylylene diisocyanate.

Specific examples of the isocyanurates include, but are not limited to, tris(isocyanatoalkyl) isocyanurate and tris (isocyanatocycloalkyl) isocyanurate.

Each of these polyisocyanates can be used alone or in combination with others.

Curing Agent

Specific examples of the curing agent include, but are not limited to, compounds having an active hydrogen group.

Compound Having Active Hydrogen Group

Specific examples of the active hydrogen group include, but are not limited to, hydroxyl groups (e.g., alcoholic hydroxyl group, phenolic hydroxyl group), amino group, carboxyl group, and mercapto group. Each of these active hydrogen groups may be included in the compound alone or in combination with others.

Preferably, the compound having an active hydrogen group is an amine, because amines are capable of forming urea bond.

Specific examples of the amine include, but are not limited to, diamines, amines having 3 or more valences, amino alcohols, amino mercaptans, and amino acids, and these amines in which the amino group is blocked. Each of these amines can be used alone or in combination with others.

In particular, diamine alone and a mixture of a diamine and a small amount of an amine having 3 or more valences are preferable. Specific examples of the diamines include, but are not limited to, aromatic diamines, alicyclic diamines, and aliphatic diamines. Specific examples of the aromatic diamines include, but are not limited to, phenylenediamine, diethyltoluenediamine, and 4,4'-diaminodiphenylmethane. Specific examples of the alicyclic diamines include, but are not limited to, 4,4'-diamino-3,3'-dimethyldicyclohexylmethane, diaminocyclohexane, and isophoronediamine. Specific examples of the aliphatic diamines include, but are not limited to, ethylenediamine, tetramethylenediamine, and hexamethylenediamine.

Specific examples of the amines having 3 or more valences include, but are not limited to, diethylenetriamine and triethylenetetramine.

Specific examples of the amino alcohols include, but are not limited to, ethanolamine and hydroxyethylaniline.

Specific examples of the amino mercaptans include, but are not limited to, aminoethyl mercaptan and aminopropyl mercaptan.

Specific examples of the amino acid include, but are not limited to, aminopropionic acid and aminocaproic acid.

Specific examples of the amines in which the amino group is blocked include, but are not limited to, ketimine compounds in which the amino group is blocked with a ketone such as acetone, methyl isobutyl ketone, and methyl ethyl ketone, and oxazoline compounds.

The molecular structure of the amorphous polyester resin B can be determined by, for example, solution or solid NMR (nuclear magnetic resonance), X-ray diffractometry, GC/MS (gas chromatography-mass spectroscopy), LC/MS (liquid chromatography-mass spectroscopy), or IR (infrared spectroscopy). For example, IR can simply detect an amorphous polyester resin as a substance showing no absorption peak based on δCH (out-of-plane bending vibration) of olefin at 965±10 $cm^{-1}$ or 990±10 $cm^{-1}$ in an infrared absorption spectrum.

Preferably, the content of the prepolymer, that is a reactive precursor of the amorphous polyester resin B, in 100 parts by mass of the toner is in the range of from 5 to 25 parts by mass, more preferably from 7 to 12 parts by mass. When the content is 5 parts by mass or more, deterioration of low-temperature fixability and high-temperature offset resistance can be suppressed. When the content is 25 parts by mass or less, deterioration of heat-resistant storage stability and lowering of gloss value of the resulting fixed image can be suppressed. When the content is within the preferred range, low-temperature fixability, high-temperature offset resistance, and blocking resistance are all excellent.

Amorphous Hybrid Resin

The toner may further include an amorphous hybrid resin. The amorphous hybrid resin includes a composite resin including a condensation polymerization resin unit and a styrene resin unit. The condensation polymerization resin unit and the styrene resin unit are partially chemically bonded to each other.

By including the amorphous hybrid resin in the toner, dispersibility of the crystalline resin (in particular, crystalline polyester resin) in the toner can be improved. Thus, the crystalline resin (in particular, crystalline polyester resin) can be finely and uniformly dispersed inside the toner. As a result, filming of the crystalline resin (in particular, crystalline polyester resin) and the release agent is suppressed, stress resistance of the toner is improved, and low-temperature fixability of the toner is achieved.

Preferably, the styrene resin unit includes a styrene-acrylic resin. By including the styrene-acrylic resin, the amorphous hybrid resin becomes more compatible with other amorphous resins. As a result, the crystalline polyester resin (in particular, crystalline polyester resin) can be more finely dispersed inside the toner.

Preferably, the amorphous hybrid resin is produced by mixing two raw material monomers, one for the condensation polymerization resin unit and the other for the styrene resin unit, having respective reaction paths, and further mixing another reactive monomer (hereinafter "bireactive monomer") reactive with both of the above two raw material monomers.

Preferably, the bireactive monomer has at least one functional group selected from hydroxyl group, carboxyl group, epoxy group, primary amino group, and secondary amino group, and an ethylenic unsaturated bond. Such a bireactive monomer can improve dispersing ability of the resin that serves as a dispersion medium. Specific examples of the bireactive monomer include, but are not limited to, acrylic acid, fumaric acid, methacrylic acid, citraconic acid, and maleic acid. In particular, acrylic acid, methacrylic acid, and fumaric acid are preferable.

Preferably, the used amount of the bireactive monomer is in the range of from 0.1 to 10 parts by mass based on 100 parts by mass of the raw material monomer for the condensation polymerization resin unit. In the present disclosure, the bireactive monomer is treated separately from the two raw material monomers for the condensation polymerization resin unit and the styrene resin unit, for its specific properties.

In a case in which the amorphous hybrid resin is produced by subjecting the mixture of the two raw material monomers and the bireactive monomer to the two types of polymerization reaction paths for forming the two resin units, the two types of polymerization reactions need not necessarily proceed or complete at the same time. The two types of polymerization reactions can separately proceed and complete while the reaction temperature and reaction time are properly adjusted depending on each reaction mechanism.

Preferably, the amorphous hybrid resin is produced by the process including: mixing a raw material monomer for the condensation polymerization resin unit, another raw material monomer for the styrene resin unit, the bireactive monomer, a polymerization initiator, a catalyst, etc.; causing mainly a radical polymerization reaction at a reaction temperature of 50° C. to 180° C. to firstly obtain the styrene resin component having a condensation-polymerizable functional group; and thereafter raising the reaction temperature to 190° C. to 270° C. to cause mainly a condensation polymerization reaction to secondarily obtain the condensation polymerization resin unit.

Preferably, the amorphous hybrid resin has a softening point in the range of from 80° C. to 170° C., more preferably from 90° C. to 160° C., and most preferably from 95° C. to 155° C.

Preferably, the mass ratio of the crystalline resin (in particular, crystalline polyester resin) to the amorphous hybrid resin is in the range of from 50/100 to 200/100, but is not limited thereto.

Preferably, the raw material monomer for the condensation polymerization resin unit includes a succinic acid derivative as a carboxylic acid component.

Specific examples of the raw material monomer for the styrene resin unit include, but are not limited to, styrene derivatives such as styrene, α-methylstyrene, and vinyl toluene.

Preferably, the content rate of the styrene derivative in the raw material monomer for the styrene resin unit is 50% by mass or more, more preferably 70% by mass or more, and most preferably 80% by mass or more.

Other than the styrene derivatives, specific examples of the raw material monomer for the styrene resin unit further include, but are not limited to: acrylic or methacrylic acid alkyl esters; ethylenic unsaturated monoolefins, such as ethylene and propylene; diolefins such as butadiene; halovinyls such as vinyl chloride; vinyl esters such as vinyl acetate and vinyl propionate; ethylenic monocarboxylic acid esters such as dimethylaminoethyl acrylate and dimethylaminoethyl methacrylate; vinyl ethers such as vinyl methyl ether; vinylidene halides such as vinyl chloride; and N-vinyl compounds such as N-vinylpyrrolidone.

Among these compounds, acrylic or methacrylic acid alkyl esters are preferable from the aspects of low-temperature fixability and charge stability of the toner. Preferably, the number of carbon atoms in the alkyl group in the acrylic or methacrylic acid alkyl esters is in the range of from 1 to 22, more preferably from 8 to 18. The number of carbon atoms in the alkyl ester refers to the number of carbon atoms derived from the alcohol component of the ester. Specific examples of the acrylic or methacrylic acid alkyl esters include, but are not limited to, methyl acrylate or methacrylate, ethyl acrylate or methacrylate, (iso)propyl acrylate or methacrylate, 2-hydroxyethyl acrylate or methacrylate, (iso- or tertiary-)butyl acrylate or methacrylate, 2-ethylhexyl acrylate or methacrylate, (iso)octyl acrylate or methacrylate, (iso)decyl acrylate or methacrylate, and (iso)stearyl acrylate or methacrylate.

Preferably, the content rate of the acrylic or methacrylic acid alkyl ester in the raw material monomer for the styrene resin unit is 50% by mass or less, more preferably 30% by mass or less, and most preferably 20% by mass or less, from the aspects of low-temperature fixability, storage stability, and charge stability of the toner.

Crystalline Resin

Preferably, the crystalline resin includes a crystalline polyester resin.

Having high crystallinity, the crystalline polyester resin has a heat melting characteristic such that the viscosity rapidly decreases at around the fixing start temperature. When used in combination with the amorphous polyester resin A, the crystalline polyester resin can maintain good storage stability below the melting start temperature owing to its crystallinity, but upon reaching the melting start temperature, the crystalline polyester resin melts while rapidly reducing its viscosity (this property may be hereinafter referred to as "sharply-melting property"). As the viscosity is rapidly reduced upon melting, the crystalline polyester resin becomes compatible with the amorphous polyester resin A and is together fixed on a recording medium. Thus, the combination of the crystalline polyester resin and the amorphous polymer resin A provides a toner that is excellent in both heat-resistant storage stability and low-temperature fixability. Such a toner also exhibits a wide releasable range (i.e., the difference between the lowest fixable temperature and the high-temperature offset generating temperature).

The crystalline polyester resin is obtained from a polyol and a polycarboxylic acid or a derivative thereof, such as a polycarboxylic acid anhydride and a polycarboxylic acid ester.

In the present disclosure, the crystalline polyester resin refers to a resin obtained from a polyol and a polycarboxylic acid or a derivative thereof, such as a polycarboxylic acid anhydride and a polycarboxylic acid ester. Modified polyester resins, such as the prepolymer described above and resins obtained by cross-linking and/or elongating the prepolymer, do not fall within the crystalline polyester resin of the present disclosure. In addition, the crystalline polyester resin is different from either the amorphous polyester resin A or the amorphous polyester resin B.

Polyol

Specific examples of the polyol include, but are not limited to, diols and alcohols having 3 or more valences.

Specific examples of the diols include, but are not limited to, saturated aliphatic diols. Specific examples of the saturated aliphatic diols include, but are not limited to, straight-chain saturated aliphatic diols and branched-chain saturated aliphatic diols. In particular, straight-chain saturated aliphatic diols are preferable, and straight-chain saturated aliphatic diols having 2 to 12 carbon atoms are more preferable. The branched-chain saturated aliphatic diols may reduce crystallinity of the crystalline polyester resin and further reduce the melting point thereof. Saturated aliphatic diols having more than 12 carbon atoms are not easily available. Thus, preferably, the number of carbon atoms is 12 or less.

Specific examples of the saturated aliphatic diols include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Among these diols, ethylene glycol, 1,4-butanediol, 1,6-hexanediol, 1,8-octanediol, 1,10-decanediol, and 1,12-dodecanediol are preferable for obtaining a crystalline polyester resin having high crystallinity and sharply-melting property.

Specific examples of the alcohols having 3 or more valences include, but are not limited to, glycerin, trimethylolethane, trimethylolpropane, and pentaerythritol.

Each of these compounds can be used alone or in combination with others.

Polycarboxylic Acid

Specific examples of the polycarboxylic acid include, but are not limited to, dicarboxylic acids and carboxylic acids having 3 or more valences.

Specific examples of the dicarboxylic acids include, but are not limited to, saturated aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids such as diprotic acids such as phthalic acid, isophthalic acid, terephthalic acid, naphthalene-2,6-dicarboxylic acid, malonic acid, and mesaconic acid; and anhydrides and lower alkyl esters (C1-C3) thereof.

Specific examples of the carboxylic acids having 3 or more valences include, but are not limited to, 1,2,4-benzenetricarboxylic acid, 1,2,5-benzenetricarboxylic acid, 1,2,4-naphthalenetricarboxylic acid, and anhydrides and lower alkyl esters (C1-C3) thereof.

The polycarboxylic acid may further include a dicarboxylic acid having sulfonic acid group, other than the above-described saturated aliphatic dicarboxylic acids or aromatic dicarboxylic acids. In addition, the polycarboxylic acid may further include a dicarboxylic acid having a double bond, other than the above-described saturated aliphatic dicarboxylic acids or aromatic dicarboxylic acids.

Each of these polycarboxylic acids can be used alone or in combination with others.

Preferably, the crystalline polyester resin is formed of a straight-chain saturated aliphatic dicarboxylic acid having 4 to 12 carbon atoms and a straight-chain saturated aliphatic diol having 2 to 12 carbon atoms.

In other words, preferably, the crystalline polyester resin has a structural unit derived from a saturated aliphatic dicarboxylic acid having 4 to 12 carbon atoms and another structural unit derived from a saturated aliphatic diol having 2 to 12 carbon atoms. Such a crystalline polyester resin has high crystallinity and sharply-melting property and thus exerts excellent low-temperature fixability.

Preferably, the melting point of the crystalline polyester resin is in the range of from 60° C. to 80° C., but is not limited thereto. When the melting point is 60° C. or more, deterioration of heat-resistant storage stability of the toner can be prevented because the crystalline polyester resin is unlikely to melt at low temperatures. When the melting point is 80° C. or less, deterioration of low-temperature fixability can be effectively prevented because the crystalline polyester resin can sufficiently melt upon application of heat when being fixed on a recording medium.

The molecular weight of the crystalline polyester resin is not limited to any particular value. As the molecular weight distribution becomes narrower and the molecular weight becomes lower, low-temperature fixability is improved. If low-molecular-weight components exist in large amounts, heat-resistant storage stability may deteriorate. In view of this, preferably, ortho-dichlorobenzene-soluble matter in the crystalline polyester resin has a weight average molecular weight (Mw) of from 20,000 to 30,000, a number average molecular weight (Mn) of from 5,000 to 10,000, and a ratio Mw/Mn of from 1.0 to 10, when measured by GPC (gel permeation chromatography). When the weight average molecular weight (Mw) is 20,000 or more, the problem that residual oligomers degrade heat-resistant storage stability and high-temperature high-humidity storage stability can be effectively prevented. When the weight average molecular weight (Mw) is 30,000 or less, deterioration of low-temperature fixability can be effectively prevented.

Preferably, the acid value of the crystalline polyester resin is 5 mgKOH/g or more, more preferably 10 mgKOH/g or more, for achieving a desired level of low-temperature fixability in terms of affinity for paper, but is not limited thereto. On the other hand, for improving high-temperature offset resistance, the acid value is preferably 45 mgKOH/g or less.

Preferably, the hydroxyl value of the crystalline polyester resin is in the range of from 0 to 50 mgKOH/g, more preferably from 5 to 50 mgKOH/g, for achieving a desired level of low-temperature fixability and a good level of charge property, but is not limited thereto.

The molecular structure of the crystalline polyester resin can be determined by, for example, solution or solid NMR (nuclear magnetic resonance), X-ray diffractometry, GC/MS (gas chromatography-mass spectroscopy), LC/MS (liquid chromatography-mass spectroscopy), or IR (infrared spectroscopy). For example, IR can simply detect a crystalline polyester resin as a substance showing an absorption peak based on δCH (out-of-plane bending vibration) of olefin at 965±10 $cm^{-1}$ or 990±10 $cm^{-1}$ in an infrared absorption spectrum.

Preferably, the content of the crystalline polyester resin in 100 parts by mass of the toner is in the range of from 3 to 20 parts by mass, more preferably from 5 to 15 parts by mass. When the content is 3 parts by mass or more, deterioration of low-temperature fixability can be effectively prevented because sharply-melting property of the crystalline polyester resin is sufficient. When the content is 20 parts by mass or less, deterioration of heat-resistant storage stability and generation of image fogging can be effectively prevented. When the content is within the preferred range, image quality and low-temperature fixability are all excellent.

Release Agent

The release agent is not limited to any particular material and selected from known materials.

Specific examples of the release agent include, but are not limited to, natural waxes such as plant waxes (e.g., carnauba wax, cotton wax, sumac wax, rice wax), animal waxes (e.g., bees wax, lanolin), mineral waxes (e.g., ozokerite, ceresin), and petroleum waxes (e.g., paraffin wax, micro-crystalline wax, petrolatum wax).

Specific examples of the release agent further include, but are not limited to, synthetic hydrocarbon waxes (e.g., Fischer-Tropsch wax, polyethylene wax, polypropylene wax) and synthetic waxes (e.g., ester wax, ketone wax, ether wax).

Furthermore, the following materials are also usable as the release agent: fatty acid amide compounds such as 12-hydroxystearic acid amide, stearic acid amide, phthalic anhydride imide, and chlorinated hydrocarbon; homopolymers and copolymers of polyacrylates (e.g., poly-n-stearyl methacrylate, poly-n-lauryl methacrylate), which are low-molecular-weight crystalline polymers; and crystalline polymers having a long alkyl side chain.

Among these materials, hydrocarbon waxes such as paraffin wax, micro-crystalline wax, Fischer-Tropsch wax, polyethylene wax, and polypropylene wax are preferable.

Preferably, the melting point of the release agent is in the range of from 60° C. to 80° C., but is not limited thereto. When the melting point is 60° C. or more, deterioration of heat-resistant storage stability can be effectively prevented because the release agent is unlikely to melt at low temperatures. When the melting point is 80° C. or less, generation of defective image can be effectively prevented because the release agent sufficiently melts within the fixable temperature range of the resin without causing fixing offset.

Preferably, the content of the release agent in 100 parts by mass of the toner is in the range of from 2 to 10 parts by mass, more preferably from 3 to 8 parts by mass. When the content is 2 parts by mass or more, deterioration of high-temperature offset resistance and low-temperature fixability can be effectively prevented. When the content is 10 parts by mass or less, deterioration of heat-resistant storage stability and generation of image fogging can be effectively prevented. When the content is within the preferred range, image quality and fixing stability are advantageously improved.

Other Constituents

The toner may further include other constituents such as a colorant, a charge control agent, an external additive, a fluidity improving agent, a cleaning improving agent, and a magnetic material.

Colorant

Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone.

The colorant can be combined with a resin to be used as a master batch. Specific examples of the resin to be used for the master batch include, but are not limited to, the amorphous polyester resin A, polymers of styrene or a derivative thereof (e.g., polystyrene, poly-p-chlorostyrene, polyvinyl toluene), styrene-based copolymers (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Each of these resins can be used alone or in combination with others.

The master batch can be obtained by mixing and kneading the resin and the colorant while applying a high shearing force thereto. To increase the interaction between the colorant and the resin, an organic solvent may be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. Preferably, the mixing and kneading is performed by a high shearing dispersing device such as a three roll mill.

Preferably, the content of the colorant in 100 parts by mass of the toner is in the range of from 1 to 15 parts by mass, more preferably from 3 to 10 parts by mass.

Charge Controlling Agent

Specific examples of usable charge controlling agents include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives. Specific examples of commercially available charge controlling agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONIRON® E-84 (metal complex of salicylic acid), and BONTRON® E-89 (phenolic condensation product), available from Orient Chemical Industries Co., Ltd.; TP-302 and TP-415 (molybdenum complexes of quaternary ammonium salts), available from Hodogaya Chemical Co., Ltd.; LRA-901, and LR-147 (boron complex), all available from Japan Carlit Co., Ltd.; and cooper phthalocyanine, perylene, quinacridone, azo pigments, and polymers having a functional group such as a sulfonic acid group, a carboxyl group, and a quaternary ammonium group.

Preferably, the content of the charge control agent in 100 parts by mass of the toner is in the range of from 0.1 to 10 parts by mass, more preferably from 0.2 to 5 parts by mass. When the content is 10 parts by mass or less, lowering of developer fluidity and deterioration of image density can be effectively prevented because the charge of the toner is not so large that the effect of the charge control agent is not reduced and therefore the electrostatic force between the toner and the developing roller is not increased. The charge controlling agent may be mixed with the binder resin or the master batch and thereafter dissolved or dispersed in an organic solvent. Of course, the charge control agent may be directly dissolved or dispersed in an organic solvent. Alternatively, the charge controlling agent may be fixed on the surface of the resulting toner particles.

External Additive

Specific examples of usable external additives include, but are not limited to, oxide fine particles, inorganic fine particles, and hydrophobized inorganic fine particles, and combinations thereof. In particular, hydrophobized inorganic fine particles, the primary particle of which having an average particle diameter of from 1 to 100 nm, more preferably from 5 to 70 nm, are preferable.

More preferably, the external additive includes at least one hydrophobized inorganic fine particle, the primary particle of which having an average particle diameter of 20 nm or less, and at least one inorganic fine particle, the primary particle of which having an average particle diameter of 30 nm or more.

Preferably, the BET specific surface area of the external additive is in the range of from 20 to 500 $m^2/g$.

Specific examples of the external additive further include, but are not limited to, fine particles of silica, hydrophobized silica, metal salts of fatty acids (e.g., zinc stearate, aluminum stearate), metal oxides (e.g., titania, alumina, tin oxide, antimony oxide), and fluoropolymers.

Specific preferred examples of the external additive include, but are not limited to, fine particles of hydrophobized silica, titania, titanium oxide, and alumina. Specific examples of commercially-available fine particle silica include, but are not limited to, R972, R974, RX200, RY200, R202, R805, and R812 (available from Nippon Aerosil Co., Ltd.). Specific examples of commercially-available fine particle titania include, but are not limited to, P-25 (available from Nippon Aerosil Co., Ltd.); STT-30 and STT-65C-S (available from Titan Kogyo, Ltd.); TAF-140 (available from Fuji Titanium Industry Co., Ltd.); and MT-150W, MT-500B, MT-600B, and MT-150A (available from TAYCA Corporation).

Specific examples of commercially available fine particle hydrophobized titanium oxide include, but are not limited to, T-805 (available from Nippon Aerosil Co., Ltd.); STT-30A and STT-65S-S (available from Titan Kogyo, Ltd.); TAF-500T and TAF-1500T (available from Fuji Titanium Industry Co., Ltd.); MT-100S and MT-100T (available from TAYCA Corporation); and IT-S (available from Ishihara Sangyo Kaisha, Ltd.).

Hydrophobized fine particles of oxide, silica, titania, or alumina can be obtained by treating fine particles of oxide, silica, titania, or alumina, which are hydrophilic, with a silane coupling agent such as methyltrimethoxysilane, methyltriethoxysilane, and octyltrimethoxysilane. In addition, silicone-oil-treated oxide fine particles or inorganic fine particles, treated with a silicone oil optionally upon application of heat, are also preferable.

Preferably, the average particle diameter of the primary particle of the inorganic fine particle is 100 nm or less, more preferably in the range of from 3 to 70 nm, but is not limited thereto. When the average particle diameter is below the preferred range, the inorganic fine particle may be embedded in the toner and cannot effectively exhibit their function. When the average particle diameter is above the preferred range, the inorganic fine particle may unevenly make flaws on the surface of the photoconductor.

Preferably, the content of the external additive in 100 parts by mass of the toner is in the range of from 0.1 to 5 parts by mass, more preferably from 0.3 to 3 parts by mass.

Fluidity Improving Agent

The fluidity improving agent is for treating the surface of the external additive for improving hydrophobicity. The fluidity improving agent is not limited to any particular material so long as deterioration of fluidity and charge property of the toner can be prevented even under high humidity environments. Specific examples of the fluidity improving agent include, but are not limited to, silane coupling agents, silylation agents, silane coupling agents having a fluorinated alkyl group, organic titanate coupling agents, aluminum coupling agents, silicone oils, and modified silicone oils. Preferably, the above-described silica and titanium oxide are surface-treated with the fluidity improving agent to become hydrophobized silica and hydrophobized titanium oxide, respectively.

Cleanability Improving Agent

The cleanability improving agent may be included in the toner to make the toner easily removable from a photoconductor or a primary transfer medium when remaining thereon after image transfer. Specific examples of the cleanability improving agent include, but are not limited to, metal salts of fatty acids (e.g., zinc stearate, calcium stearate) and fine particles of polymers prepared by soap-free emulsion polymerization (e.g., polymethyl methacrylate, polystyrene). Preferably, the particle size distribution of the fine particles of polymers is as narrow as possible. More preferably, the volume average particle diameter thereof is in the range of from 0.01 to 1 μm.

Magnetic Material

Specific examples of usable magnetic materials include, but are not limited to, iron powder, magnetite, and ferrite. In particular, those having white color are preferable.

Preferably, the melting point of the toner is in the range of from 60° C. to 80° C., but is not limited thereto.

Preferably, the volume average particle diameter of the toner is in the range of from 3 to 7 μm, but is not limited thereto. In addition, preferably, the ratio of the volume average particle diameter to the number average particle diameter is 1.2 or less. Furthermore, preferably, the toner includes toner particles having a volume-based particle diameter of 2 μm or less in an amount of from 1% to 10% by number.

Toner Properties

Preferably, a glass transition temperature of the toner (hereinafter "Tg1st (toner)"), measured in the first heating of differential scanning calorimetry (DSC), is in the range of from 20° C. to 50° C.

Conventional toners which have a Tg of 50° C. or less easily generate toner aggregation when transported in summer season or tropical regions or stored under a temperature-variable environment. As a result, such a conventional toner may be solidified in a toner bottle or fixedly adhered to a developing device. In these cases, toner clogging occurs within the toner bottle and defective toner supply is caused, or abnormal image is generated due to the occurrence of toner adhesion to the developing device.

The toner according to an embodiment of the present invention has a glass transition temperature lower than a conventional toner. On the other hand, when the amorphous resin (in particular, the amorphous polyester resin B) serving as a low Tg component in the toner is non-linear, the toner can maintain heat-resistant storage stability. In a case in which the amorphous resin (in particular, the amorphous polyester resin B) is an amorphous polyester resin having urethane bond or urea bond each having a high cohesive force, the toner can maintain heat-resistant storage stability in a more effective manner.

When Tg1st (toner) is 20° C. or more, deterioration of heat-resistant storage stability and the occurrence of toner blocking in a developing device and toner filming on a photoconductor can be prevented. When Tg1st (toner) is 50° C. or less, deterioration of low-temperature fixability of the toner can be prevented.

Preferably, the toner includes tetrahydrofuran-insoluble (THF-insoluble) matter.

Preferably, the THF-insoluble matter includes the amorphous polyester resin B. Preferably, the amorphous polyester resin B is an amorphous polyester resin including a diol component including 50% by mol or more of an aliphatic diol having 3 to 10 carbon atoms and a cross-linked component including an aliphatic alcohol having 3 or more valences.

Difference in Solubility Parameter Between Amorphous Resin and Crystalline Resin Preferably, the toner further satisfies the following inequality, where SP1 and SP2 represent solubility parameters ($cal^{1/2}/cm^{3/2}$) of the amorphous resin and the crystalline resin, respectively.

$$0.5<SP1-SP2<1.1$$

When the difference (SP1−SP2) between the solubility parameter (SP1) of the amorphous resin and the solubility parameter (SP2) of the crystalline resin is greater than 0.5, deterioration of high-temperature-and-high-humidity-resistant storage stability and mechanical strength can be effectively prevented because the degree of phase-mixing between the amorphous resin and the crystalline resin is not so increased and therefore the degree of crystallization of the crystalline resin is not so decreased.

When the difference (SP1−SP2) is less than 1.1, deterioration of high-temperature-and-high-humidity-resistant storage stability and mechanical strength can be effectively prevented because the crystalline resin may not locally located near the surface of the toner due to interaction of polarity.

Calculation Method for Solubility Parameter

The solubility parameter ($cal^{1/2}/cm^{3/2}$) is represented by the square root of the vaporization energy per unit volume. Based on the Fedors' method, the solubility parameter is calculated from the following formula: Solubility Parameter $(SP)=(E/V)^{1/2}$, where E represents vaporization energy (cal/mol) and V represents molar volume ($cm^3$/mol).

E and V are respectively represented by the following formulae: $E=\Sigma\Delta ei$ and $V=\Sigma\Delta vi$, where $\Delta ei$ and $\Delta vi$ respectively represent vaporization energy and molar volume of an atomic group. (Details are available in a publication "Imoto, Minoru, *Basic Theory of Gluing*, Macromolecule Publication Meeting, pp. 89-103.").

It is to be noted that SP values listed in Tables in the following Examples are calculated without considering terminal function groups.

Calculation and Analysis Methods for Various Properties of Toner and Toner Constituents Various properties (e.g., Tg, acid value, hydroxyl value, molecular weight, melting point) of each of the toner constituents, i.e., the amorphous polyester resin A, the amorphous polyester resin B, the amorphous hybrid resin, the crystalline polyester resin, and the release agent, can be measured with the single body thereof. Alternatively, each of the toner constituents may be separated (isolated) from the toner by gel permeation chromatography (GPC), etc., and thereafter subjected to specific analysis (to be described later) to determine various properties (e.g., Tg, molecular weight, melting point, mass ratio among toner constituents).

Each of the toner constituents can be separated from the toner by GPC in the following manner.

In a GPC measurement using THF (tetrahydrofuran) as a mobile phase, the elute is divided into fractions by a fraction collector, and the fractions corresponding to the desired molecular weight portion in the total area of the elution curve are collected.

The collected fractions of the elute are condensed and dried by an evaporator, etc. The resulting solid is dissolved in a deuterated solvent, such as deuterated chloroform or THF, and subjected to $^1$H-NMR measurement to determine integrated ratio of each element and calculate the constitutional monomer ratio in the eluted components.

Alternatively, the constitutional monomer ratio may be determined by hydrolyzing the condensed elute with sodium hydroxide, etc., and subjecting the decomposition product to a qualitative quantitative analysis by high-performance liquid chromatography (HPLC). In this case, preferably, compatibility between the measured value and that measured by $^1$H-NMR is previously confirmed or a conversion table therebetween is previously confirmed.

In a case in which the toner is produced by a method including the process of forming the amorphous polyester resin B by an elongation reaction and/or a cross-linking reaction between the non-linear reactive precursor and the curing agent while forming mother toner particles, the amorphous polyester resin B may be separated from the toner by GPC, etc. to determine Tg, etc. with the separated amorphous polyester resin B. Alternatively, the amorphous polyester resin B may be previously synthesized by an elongation reaction and/or a cross-linking reaction between the non-linear reactive precursor and the curing agent, and the properties such as Tg may be determined with the synthesized amorphous polyester resin B.

Separation of Toner Constituents

One example method for separating toner constituents from the toner is described below.

First, 1 g of the toner is poured in 100 mL of THF and stirred at 25° C. for 30 minutes to obtain a solution dissolving THF-soluble matter.

The solution is filtered with a membrane filter having an opening of 0.2 μm to separate (isolate) THF-soluble matter from the toner.

The THF-soluble matter is dissolved in THF to prepare a sample for GPC measurement. The sample is injected into a GPC instrument.

A fraction collector, disposed at the elute discharge port of the GPC instrument, collects a fraction of the elute at every predetermined count. Every time the collected fractions correspond to 5% of the area of the elution curve, the collected fractions are separated.

Each separated elute in an amount of 30 mg is dissolved in 1 mL of deuterated chloroform. As a standard substance, 0.05% by volume of tetramethylsilane (TMS) is further added thereto.

The resulting solution is poured in a glass tube having a diameter of 5 mm and subjected to an NMR measurement using a nuclear magnetic resonance spectrometer (JNM-AL400 available from JEOL Ltd.) to obtain a spectrum. The measurement is performed at a temperature of 23° C. to 25° C., and the number of accumulation is 128.

The monomer composition and composition ratio of each toner constituent, such as the amorphous polyester resin A, the amorphous polyester resin B, the amorphous hybrid resin, and the crystalline polyester resin, can be determined from the peak integral ratio of the spectrum.

Specifically, a monomer composition ratio can be determined by peak assignment.

For example, a peak at around 8.25 ppm is assigned to the benzene ring of trimellitic acid (corresponding to one hydrogen atom); a peak at around 8.07 to 8.10 ppm is assigned to the benzene ring of terephthalic acid (corresponding to four hydrogen atoms); a peak at around 7.1 to 7.25 ppm is assigned to the benzene ring of bisphenol A (corresponding to four hydrogen atoms); a peak at around 6.8 ppm is assigned to the benzene ring of bisphenol A (corresponding to four hydrogen atoms) and the double bond of fumaric acid (corresponding to two hydrogen atoms); a peak at around 5.2 to 5.4 ppm is assigned to the methine of propylene oxide adduct of bisphenol A (corresponding to one hydrogen atom); a peak at around 3.7 to 4.7 ppm is assigned to the methylene of propylene oxide adduct of bisphenol A (corresponding to two hydrogen atoms) and the methylene of ethylene oxide adduct of bisphenol A (corresponding to four hydrogen atoms); and a peak at around 1.6 ppm is assigned to the methyl group of bisphenol A (corresponding to six hydrogen atoms).

As a result of peak assignment, the collected fractions of the elute in which the amorphous polyester resin A accounts for 90% or more can be treated as the amorphous polyester resin A.

Similarly, the collected fractions of the elute in which the amorphous polyester resin B accounts for 90% or more can be treated as the amorphous polyester resin B. Similarly, the collected fractions of the elute in which the crystalline polyester resin accounts for 90% or more can be treated as the crystalline polyester resin.

Measurement of Hydroxyl Value and Acid Value

The hydroxyl value can be measured based on a method according to JIS K0070-1966 as follows.

First, 0.5 g of a sample is precisely weighed in a 100-mL measuring flask, and 5 mL of an acetylating agent is further put in the flask. The flask is heated in a hot bath at 100±5° C. for 1 to 2 hours. The flask is thereafter taken out from the bath and let stand to cool. Water is poured in the flask and the flask is shaken so that acetic anhydride is decomposed. To completely decompose acetic anhydride, the flask is reheated in the warm bath for 10 minutes or more and thereafter let stand to cool. The wall of the flask is sufficiently washed with an organic solvent.

The flask content is subjected to a measurement of hydroxyl value at 23° C. with an automatic potentiometric titrator DL-53 TITRATOR and electrodes DG113-SC (both available from Mettler-Toledo International Inc.) and an analysis with an analysis software program LabX Light Version 1.00.000.

The calibration of the instrument is performed with a mixed solvent of 120 ml of toluene and 30 ml of ethanol under the following condition.

| | | |
|---|---|---|
| Measurement Conditions | | |
| Stir | | |
| Speed [%] | 25 | |
| Time [s] | 15 | |
| EQP Titration | | |
| Titrant/Sensor | | |
| Titrant | $CH_3ONa$ | |
| Concentration [mol/L] | | 0.1 |
| Sensor | DG115 | |
| Unit of measurement | | mV |
| Predispensing to volume | | |
| Volume [mL] | 1.0 | |
| Wait time [s] | 0 | |
| Titrant addition Dynamic | | |
| dE(set) [mV] | 8.0 | |
| dV(min) [mL] | 0.03 | |
| dV(max) [mL] | 0.5 | |
| Measure mode Equilibrium controlled | | |
| dE [mV] | 0.5 | |
| dt [s] | 1.0 | |
| t(min) [s] | 2.0 | |
| t(max) [s] | 20.0 | |
| Recognition | | |
| Threshold | 100.0 | |
| Steepest jump only | | No |
| Range | No | |
| Tendency | None | |

-continued

| | | |
|---|---|---|
| Termination | | |
| at maximum volume [mL] | | 10.0 |
| at potential | No | |
| at slope | No | |
| after number EQPs | | Yes |
| n = 1 | | |
| comb. termination conditions | | No |
| Evaluation | | |
| Procedure | Standard | |
| Potential 1 | No | |
| Potential 2 | No | |
| Stop for reevaluation | | No |

The acid value can be measured based on a method according to JIS K0070-1992 as follows.

First, 0.5 g of a sample (or 0.3 g of ethyl-acetate-soluble matter in the sample) is stir-mixed with 120 ml of toluene at 23° C. for about 10 hours to be dissolved in the toluene. Further, 30 ml of ethanol is mixed therein, thus preparing a sample solution. In a case in which the sample is insoluble in toluene, another solvent such as dioxane and tetrahydrofuran may be used. The flask content is subjected to a measurement of acid value at 23° C. with an automatic potentiometric titrator DL-53 TITRATOR and electrodes DG113-SC (both available from Mettler-Toledo International Inc.) and an analysis with an analysis software program LabX Light Version 1.00.000. The calibration of the instrument is performed with a mixed solvent of 120 ml of toluene and 30 ml of ethanol under the above-described condition for measuring hydroxyl value.

More specifically, the sample solution is titrated with a 0.1N potassium hydroxide/alcohol solution, and the acid value is calculated from the following formula: Acid Value (mgKOH/g)=Titration Amount (mL)×56.1 (mg/mL)/Sample Amount (g), where N represents the factor of the 0.1N potassium hydroxide/alcohol solution.

Measurement of Melting Point and Glass Transition Temperature (Tg)

Melting points and glass transition temperatures (Tg) of a sample can be measured with a DSC system (differential scanning calorimeter Q-200 available from TA Instruments) as follows.

First, about 5.0 mg of a sample is put in an aluminum sample container. The sample container is put on a holder unit and set in an electric furnace. The sample container is heated from −80° C. to 150° C. at a temperature rising rate of 10° C./min ("first heating") in nitrogen atmosphere. The sample container is thereafter cooled from 150° C. to −80° C. at a temperature falling rate of 10° C./min and heated to 150° C. again at a temperature rising rate of 10° C./min ("second heating"). In each of the first heating and the second heating, a DSC curve is obtained by the differential scanning calorimeter (Q-200 available from TA Instruments).

The obtained DSC curves are analyzed with analysis program installed in Q-200. By selecting the DSC curve obtained in the first heating, a glass transition temperature in the first heating can be determined. Similarly, by selecting the DSC curve obtained in the second heating, a glass transition temperature in the second heating can be determined.

In addition, by selecting the DSC curve obtained in the first heating, an endothermic peak temperature in the first heating can be determined as a melting point in the first heating. Similarly, by selecting the DSC curve obtained in the second heating, an endothermic peak temperature in the second heating can be determined as a melting point in the second heating.

In the present disclosure, Tg1st and Tg2nd denote glass transition temperatures measured in the first heating and the second heating, respectively, especially when the sample is a toner.

In the present disclosure, glass transition temperatures and melting points of the toner constituents, such as the amorphous polyester resin A, the amorphous polyester resin B, the amorphous hybrid resin, the crystalline polyester resin, and the release agent, are those measured in the second heating, unless otherwise specified.

Measurement of Particle Size Distribution

The volume average particle diameter (Dv) and number average particle diameter (Dn) of the toner can be measured by a particle size analyzer such as COULTER COUNTER TA-II and COULTER MULTISIZER II (both available from Beckman Coulter, Inc.). In the present disclosure, Dv and Dn are measured with COULTER MULTISTZER II in the following manner.

First, 0.1 to 5 mL of a surfactant (preferably a polyoxyethylene alkyl ether (a nonionic surfactant)), as a dispersant, is added to 100 to 150 ml of an electrolyte solution. Here, the electrolyte solution is a 1% by mass NaCl aqueous solution prepared with the first grade sodium chloride, such as ISOTON-II (available from Beckman Coulter, Inc.). Further, 2 to 20 mg of a sample is added thereto. The electrolyte solution, in which the sample is suspended, is subjected to a dispersion treatment with an ultrasonic disperser for about 1 to 3 minutes. The electrolyte solution is thereafter subjected to a measurement of the volume and number of toner particles with the above particle size analyzer equipped with a 100-μm aperture, to calculate volume and number distributions. The volume average particle diameter (Dv) and number average particle diameter (Dn) are calculated from the volume and number distributions, respectively, measured above.

Thirteen channels with the following ranges are used for the measurement: not less than 2.00 μm and less than 2.52 μm; not less than 2.52 μm and less than 3.17 μm; not less than 3.17 μm and less than 4.00 μm; not less than 4.00 μm and less than 5.04 μm; not less than 5.04 μm and less than 6.35 μm; not less than 6.35 μm and less than 8.00 μm; not less than 8.00 μm and less than 10.08 μm; not less than 10.08 μm and less than 12.70 μm; not less than 12.70 μm and less than 16.00 μm; not less than 16.00 μm and less than 20.20 μm; not less than 20.20 μm and less than 25.40 μm; not less than 25.40 μm and less than 32.00 μm; and not less than 32.00 μm and less than 40.30 μm. Namely, particles having a particle diameter not less than 2.00 μm and less than 40.30 μm are to be measured.

Measurement of Molecular Weight

Molecular weights of the toner constituents can be measured as follows.

Gel permeation chromatography instrument: HLC-8220 GPC (available from Tohsoh Corporation) Column: TSKgel SuperHZM-H 15 cm Triple (available from Tosoh Corporation) Temperature: 40° C. Solvent: Tetrahydrofuran (THF) Flow rate: 0.35 mL/min Sample concentration: 0.15%, Injection amount: 0.4 mL Pretreatment of Sample: Prepare a 0.15% tetrahydrofuran (THF, containing a stabilizer, from Wako Pure Chemical Industries, Ltd.) solution of a measurement target. Filter the solution with 0.2-μm filter and use the filtrate as a sample. The molecular weight of the sample is determined by comparing the molecular weight distribution of the sample with a calibration curve, compiled with several types of monodisperse polystyrene standard samples, that shows the relation between the logarithmic values of molecular weights and the number of counts. The standard polystyrene samples used to create the calibration curve include Showdex STANDARD Std. No. S-7300, S-210, S-390, S-875, S-1980, S-10.9, S-629, S-3.0, and S-0.580 available from Showa Denko K.K. As the detector, a refractive index (RI) detector is used.

Method for Extracting THF-Insoluble and THF-Soluble Matters

THF-insoluble matter and THF-soluble matter in the toner can be extracted as follows. First, 1 g of the toner and 100 g of THF are mixed and refluxed for 12 hours. The insoluble matter (solid content) and the soluble matter (liquid content) are thereafter separately collected.

After removing the THF from the soluble matter (liquid content), the soluble matter is dried for 20 hours at 40° C. at normal pressures and for subsequent 20 hours at 23° C. at reduced pressures, to isolate THF-soluble matter.

The insoluble matter (solid content) is dried for 20 hours at 40° C. at normal pressures and for subsequent 20 hours at 23° C. at reduced pressures, to isolate THF-insoluble matter.

Method for Manufacturing Toner

Preferably, the toner is manufactured by a method including the process of dispersing an oily phase containing the amorphous resin, the crystalline resin, and the release agent, in an aqueous medium.

Examples of such a method include dissolution suspension methods.

More specifically, the toner is preferably manufactured by a dissolution suspension method further including the processes of: dissolving the crystalline resin and the release agent in an organic solvent by application of heat to prepare a solution; and cooling the solution to prepare a dispersion liquid of a composite particle in which the crystalline resin and the release agent are partially combined by recrystallizing the crystalline resin and the release agent.

Preparing a dispersion liquid of a composite particle in which the crystalline resin and the release agent are partially combined is one feature of this toner manufacturing process.

The process of preparing a dispersion liquid of a composite particle in which the crystalline resin and the release agent are partially combined is described in detail later.

The toner can be manufactured by a typical dissolution suspension method (to be described later) includes the process of dispersing an oily phase in an aqueous medium, where the oily phase contains the amorphous polyester resin A, the crystalline polyester resin, and the release agent, and optionally the amorphous polyester resin B, the amorphous hybrid resin, and the colorant.

In this method, mother toner particles are formed while the amorphous polyester resin B is formed by an elongation reaction and/or a cross-linking reaction between the non-linear reactive precursor and the curing agent.

The processes of preparing the aqueous medium, preparing the oily phase including toner constituents, emulsifying or dispersing the toner constituents, and removing organic solvents in the above methods are described in detail below.

Method for Preparing Dispersion Liquid of Composite Particle of Crystalline Resin and Release Agent The method for manufacturing toner according to an embodiment of the present invention includes the processes of: dissolving the crystalline resin and the release agent in an organic solvent by application of heat to prepare a solution; and cooling the solution to prepare a dispersion liquid of a composite particle in which the crystalline resin and the release agent are partially combined by recrystallizing the crystalline resin and the release agent. In this method, the release agent has a crystallization temperature higher than the crystalline resin by 20° C. or more.

Generally, by dissolving a crystalline resin and a release agent in an organic solvent by application of heat to prepare a solution and thereafter cooling the solution, a dispersion liquid of fine particles of the crystalline resin and the release agent can be prepared by recrystallizing the crystalline resin and the release agent. In particular, when the release agent has a crystallization temperature higher than the crystalline resin by 20° C. or more, the release agent starts recrystallization first in cooling the solution, and a part of the crystalline resin starts recrystallization from the recrystallized release agent portion. Thus, a dispersion liquid of the composite particle in which a part of the crystalline resin is combined with release agent is prepared. By introducing the composite particle to the toner, the release agent can be located between the amorphous resin and the crystalline resin, thus reducing the contact area therebetween and suppressing partial compatibilization therebetween.

Organic Solvent

The organic solvent used to prepare the dispersion liquid is not limited to any particular material so long as it does not dissolve the crystalline resin and the release agent at low temperatures but dissolves them when heat is applied to form a uniform solution thereof. Specific examples of such organic solvents include, but are not limited to, toluene, ethyl acetate, and methyl ethyl ketone. Each of these solvents can be used alone or in combination with others.

Generally, during the cooling process for recrystallization, the particle size of the recrystallized particles varies depending on the solid content concentration of the solution and the cooling rate. In the present disclosure, preferably, the concentration and temperature of the solution are controlled within a certain range so that the crystalline resin and the release agent are properly combined.

Preferably, the solid content concentration of the solution is in the range of from 1% to 40%, more preferably from 5% to 20%. When the concentration is low, the recrystallized particles become small, and productivity and cost deteriorate. When the concentration is high, the recrystallized particles become large. Depending on the types of the crystalline resin and the release agent, the viscosity of the solution significantly increases and handling performance thereof in the toner manufacturing process degrades. Preferably, the proportion of the crystalline resin to the release agent in the solution is in the range of from 50% to 200% by mass, more preferably from 100% to 120% by mass. When the proportion of the crystalline resin to the release agent is too high, the effect of reducing the contact area between the amorphous resin and the crystalline resin in the resulting toner may be insufficient.

In the heating and cooling operations, first, the crystalline resin and the release agent are added to the organic solvent and stirred at a temperature equal to or below the boiling point of the organic solvent for about 10 to 30 minutes to prepare a uniform transparent solution. The crystalline resin and the release agent may be previously mixed before being dissolved in an organic solvent, or alternatively, respective solutions of the crystalline resin and the release agent may be previously prepared and thereafter mixed.

The resulting solution is cooled so that the crystalline resin and the release agent are recrystallized. Preferably, the cooling rate is in the range of from 0.1° C./min to 40° C./min, and more preferably from 0.5° C./min to 30° C./min. Furthermore, the lower limit of the cooling rate is preferably 0.51° C./min or more, and more preferably from 2° C./min to 30° C./min.

As described above, preferably, the release agent has a crystallization temperature higher than the crystalline resin by 20° C. or more. Thus, the composite particle in which the release agent and the crystalline resin are properly combined is prepared.

Additional Pulverization Process

The dispersion liquid of the composite particle obtained by recrystallization may be further subjected to an additional pulverization process to make the composite particle much finer. Since the crystalline resin and the release agent are sufficiently fine in the composite particle prepared in the recrystallization process, the crystalline resin and the release agent can maintain the combined state even when being subjected to the additional pulverization process. By further making the particles much finer, the crystalline resin and the release agent can be more uniformly located in the toner. Preferably, the composite particle of the crystalline resin and the release agent has a volume average particle diameter in the range of from 0.2 to 2 μm.

Pulverization devices for use in the pulverization process include commercially-available pulverizers, such as ball mill, bead mill, and sand mill, but are not limited thereto.

Cooling Rate

As the cooling rate becomes higher, the particle diameter of the recrystallized particle becomes smaller. This is because, when the cooling rate is high, the rate of decline of saturated solubility is so rapid that crystal nucleation easily occurs to resolve the supersaturated state. On the other hand, when the cooling rate is low, saturated solubility declines slowly and therefore crystal growth dominates over crystal nucleation, thereby making the particle diameter of the recrystallized particles much larger. In view of this, it is considered that the combined state between the crystalline resin and the release agent can be controlled by controlling the cooling rate. In the present disclosure, the release agent is deposited prior to the crystalline resin in the cooling process. When the cooling rate is increased in the process of crystallization of the release agent, crystal nucleation of the release agent is accelerated. As a result, the deposited release agent particles become small in size and large in total surface area. When the cooling rate is thereafter lowered upon reaching the crystallization start temperature of the crystalline resin, the crystalline resin starts crystal growth from the already-deposited release agent particles rather than causes crystal nucleation alone. Thus, the composite degree of the release agent and the crystalline resin is increased. When the cooling rate is lowered in the process of crystallization of the release agent, the deposited release agent particles become large in size and small in total surface area. When the cooling rate is thereafter increased upon reaching the crystallization start temperature of the crystalline resin, the crystalline resin is more likely to cause crystal nucleation alone because the number of the deposited release agent particles, from which the crystalline resin can starts crystal growth, is small and the rate of decline of saturated solubility is rapid. As a result, the release agent and the crystalline resin are separated from each other, lowering the composite degree of the release agent and the crystalline resin.

Preferably, the cooling rate in the recrystallization process of the release agent is adjusted to 10° C./min to 30° C./min, and the cooling rate in the recrystallization process of the crystalline resin is adjusted to 0.5° C./min to 10° C./min.

Preparation of Aqueous Medium (Aqueous Phase)

The aqueous medium may disperse resin particles therein. Preferably, the added amount of the resin particles in the aqueous medium is in the range of from 0.5 to 10 parts by mass based on 100 parts of the aqueous medium.

Specific examples of the aqueous medium include, but are not limited to, water, water-miscible solvents, and mixtures thereof. Each of these media can be used alone or in combination with others. In particular, water is preferable.

Specific examples of the water-miscible solvents include, but are not limited to, alcohols, dimethylformamide, tetrahydrofuran, cellosolves, and lower ketones. Specific examples of the alcohols include, but are not limited to, methanol, isopropanol, and ethylene glycol. Specific examples of the lower ketones include, but are not limited to, acetone and methyl ethyl ketone.

Preparation of Oily Phase

The oily phase may be prepared by dissolving or dispersing toner constituents in an organic solvent, where the toner constituents include at least the amorphous polyester resin A, the crystalline polyester resin, and the release agent, and optionally the reactive precursor (prepolymer) of the amorphous polyester resin B, the curing agent, and/or the colorant.

Preferably, the organic solvent used for the oily phase is an organic solvent having a boiling point less than 150° C., that is easy to remove, but is not limited thereto.

Specific examples of the organic solvent having a boiling point less than 150° C. include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Each of these solvents can be used alone or in combination with others.

Among these solvents, ethyl acetate, toluene, xylene, benzene, methylene chloride, 1,2-dichloroethane, chloroform, and carbon tetrachloride are preferable, and ethyl acetate is most preferable.

Emulsification or Dispersion

The oily phase containing the toner constituents is emulsified or dispersed in the aqueous medium. At the time the oily phase is emulsified or dispersed, the amorphous polyester resin B is formed by an elongation reaction and/or a cross-linking reaction between the curing agent and the non-linear reactive precursor.

The amorphous polyester resin B may be formed by one of the following procedure (1) to (3).

(1) Emulsify or disperse an oily phase containing the non-linear reactive precursor and the curing agent in an aqueous medium, to cause an elongation reaction and/or a cross-linking reaction between the curing agent and the non-linear reactive precursor in the aqueous medium, thereby forming the amorphous polyester resin B.

(2) Emulsify or disperse an oily phase containing the non-linear reactive precursor in an aqueous medium to which the curing agent has been previously added, to cause an elongation reaction and/or a cross-linking reaction between the curing agent and the non-linear reactive precursor in the aqueous medium, thereby forming the amorphous polyester resin B.

(3) Emulsify or disperse an oily phase containing the non-linear reactive precursor in an aqueous medium and thereafter add the curing agent to the aqueous medium, to cause an elongation reaction and/or a cross-linking reaction between the curing agent and the non-linear reactive precursor in the aqueous medium from the interfaces of dispersed particles, thereby forming the amorphous polyester resin B.

In a case in which an elongation reaction and/or a cross-linking reaction between the curing agent and the non-linear reactive precursor is caused from the interfaces of dispersed particles, the amorphous polyester resin B is preferentially formed at the surface of the resulting toner while forming a concentration gradient of the amorphous polyester resin B within the toner.

The reaction conditions (e.g., reaction time, reaction temperature) for forming the amorphous polyester resin B are not limited and determined depending on the combination of the curing agent and the non-linear reactive precursor.

Preferably, the reaction temperature is in the range of from 10 minutes to 40 hours, more preferably from 2 to 24 hours, but is not limited thereto.

Preferably, the reaction temperature is in the range of from 0° C. to 150° C., more preferably from 40° C. to 98° C., but is not limited thereto.

The non-linear reactive precursor may be stably dispersed in the aqueous medium by, for example, adding an oily phase in which the toner constituents is dissolved or dispersed to the aqueous medium and thereafter applying a shearing force to disperse the oily phase in the aqueous medium.

Examples of dispersers for dispersing the oily phase include, but are not limited to, low-speed shearing type dispersers, high-speed shearing type dispersers, friction type dispersers, high-pressure jet type dispersers, and ultrasonic dispersers.

Among these dispersers, high-speed shearing type dispersers are preferable because they can adjust the particle diameter of the dispersoids (oil droplets) to 2 to 20 μm.

When a high-speed shearing type disperser is used, dispersing conditions, such as the number of revolution, dispersing time, and dispersing temperature, are determined depending on the purpose.

Preferably, the number of revolution is in the range of from 1,000 to 30,000 rpm, more preferably from 5,000 rpm to 20,000 rpm, but is not limited thereto.

Preferably, the reaction time is in the range of from 0.1 to 5 minutes in the case of batch-type disperser, but is not limited thereto.

Preferably, the dispersing temperature is in the range of from 0° C. to 150° C., more preferably from 40° C. to 98° C., under pressure, but is not limited thereto. Generally, as the dispersing temperature becomes higher, the dispersing becomes easier.

Preferably, the amount of the aqueous medium used when the toner constituents are emulsified or dispersed therein is in the range of from 50 to 2,000 parts by mass, more preferably from 100 to 1,000 parts by mass, based on 100 parts by mass of the toner constituents.

When the used amount of the aqueous medium is 50 parts by mass or more, the dispersion state of the toner constituents is suppressed from degrading so that mother toner particles having a desired particle size can be obtained. When the used amount of the aqueous medium is 2,000 parts by mass or less, manufacturing cost can be lowered.

Preferably, when the oily phase containing the toner constituents is emulsified or dispersed in the aqueous medium, a dispersant is used to stabilize dispersoids (oil droplets) to obtain toner particles with a desired shape and a narrow particle size distribution.

Specific examples of the dispersant include, but are not limited to, surfactants, poorly-water-soluble inorganic compounds, and polymeric protection colloids.

Each of these dispersers can be used alone or in combination with others.

In particular, surfactants are preferable.

Usable surfactants include anionic surfactants, cationic surfactants, nonionic surfactants, and ampholytic surfactants.

Specific examples of the anionic surfactants include, but are not limited to, alkylbenzene sulfonate, α-olefin sulfonate, and phosphate.

Among these surfactants, those having a fluoroalkyl group are preferred.

In the elongation reaction and/or cross-linking reaction for forming the amorphous polyester resin B, a catalyst may be used.

Specific examples of the catalyst include, but are not limited to, dibutyltin laurate and dioctyltin laurate.

Removal of Organic Solvent

The organic solvent may be removed from the dispersion liquid (emulsion slurry) by, for example, gradually raising the temperature of the reaction system to completely evaporate the organic solvent from oil droplets, or spraying the dispersion liquid into dry atmosphere to completely evaporate the organic solvent from oil droplets.

As the organic solvent has been removed, mother toner particles are isolated. The mother toner particles are washed and dried, and optionally classified by size. The classification may be performed by removing ultrafine particles by cyclone separation, decantation, or centrifugal separation. Alternatively, the classification may be performed after the mother toner particles have been dried.

The mother toner particles may be further mixed with particulate external additives, charge control agents, etc. By applying a mechanical impact in the mixing, the particulate external additives, etc. are suppressed from releasing from the surface of the mother toner particles.

A mechanical impulsive force can be applied using blades rotating at a high speed, or by accelerating the mother toner particles in a high-speed airflow to allow the toner particles collide with each other or a collision plate.

A mechanical impulsive force can be applied using, for example, ONG MILL (from Hosokawa Micron Co., Ltd.), a modified I-TYPE MILL in which the pulverizing air pressure is reduced (from Nippon Pneumatic Mfg. Co., Ltd.), HYBRIDTZATION SYSTEM (from Nara Machine Co., Ltd.), KRYPTON SYSTEM (from Kawasaki Heavy Industries, Ltd.), or an automatic mortar.

Developer

The developer according to an embodiment includes at least the above-described toner and optionally other components such as a carrier.

The developer is excellent in transferability and chargeability and can reliably form high quality image. The developer may be either one-component developer or two-component developer. To be used for high-speed printers corresponding to recent improvement in information processing speed, two-component developer is preferable, because the lifespan can be extended.

Carrier

The carrier may include a core material and a resin layer that covers the core material.

Toner Storage Unit

The toner storage unit according to an embodiment of the present invention includes a storage unit and the toner according to an embodiment of the present invention stored in the storage unit. The toner storage unit may be in the form of, for example, a toner storage container, a developing device, or a process cartridge.

In the present disclosure, the toner storage container refers to a container storing the toner.

The developing device refers to a device storing the toner and having a developing unit.

The process cartridge refers to a combined body of an image bearer with a developing unit storing the toner, detachably attachable to an image forming apparatus. The process cartridge may further include a charger, an irradiator, and/or a cleaner.

An image forming apparatus to which the toner storage unit is attached can perform image formation making use of the toner according to an embodiment of the present invention that is excellent in heat-resistant storage stability and mechanical strength while maintaining low-temperature fixability.

Image Forming Apparatus and Image Forming Method

An image forming apparatus according to an embodiment includes at least an electrostatic latent image bearer, an electrostatic latent image forming device, and a developing device, and optionally other members.

An image forming method according to an embodiment includes at least an electrostatic latent image forming process and a developing process, and optionally other processes.

The image forming method is preferably performed by the image forming apparatus. The electrostatic latent image forming process is preferably performed by the electrostatic latent image forming device. The developing process is preferably performed by the developing device. Other optional processes are preferably performed by other optional members.

Electrostatic Latent Image Bearer

The electrostatic latent image bearing member is not limited in material, structure, and size. Specific examples of usable materials include, but are not limited to, inorganic photoconductors such as amorphous silicon and selenium, and organic photoconductors such as polysilane and phthalopolymethine. Among these materials, amorphous silicon is preferable in terms of long operating life.

Electrostatic Latent Image Forming Device and Electrostatic Latent Image Forming Process The electrostatic latent image forming device has no limits so long as it can form an electrostatic latent image on the electrostatic latent image bearer. For example, the electrostatic latent image forming device may include a charger to uniformly charge a surface of the electrostatic latent image bearer and an irradiator to irradiate the surface of the electrostatic latent image bearer with light containing image information.

The electrostatic latent image forming process has no limits so long as an electrostatic latent image can be formed on the electrostatic latent image bearer. For example, the electrostatic latent image forming process may include charging a surface of the electrostatic latent image bearing member and irradiating the surface with light containing image information. The electrostatic latent image forming process can be performed by the electrostatic latent image forming device.

Charger and Charging Process

Specific examples of the charger include, but are not limited to, contact chargers equipped with a conductive or semiconductive roller, brush, film, or rubber blade, and non-contact chargers employing corona discharge such as corotron and scorotron.

The charging process may include applying a voltage to a surface of the electrostatic latent image bearer by the charger.

Irradiator and Irradiating Process

The irradiator has no limits so long as it can emit light containing image information to the surface of the electrostatic latent image bearer charged by the charger. Specific examples of the irradiator include, but are not limited to, various irradiators of radiation optical system type, rod lens array type, laser optical type, and liquid crystal shutter optical type.

Developing Device and Developing Process

The developing device has no limits so long as it stores a toner and develops the electrostatic latent image formed on the electrostatic latent image bearer into a visible image with the toner.

The developing process has no limits so long as the electrostatic latent image formed on the electrostatic latent image bearer can be developed into a visible image with a toner. The developing process is preferably performed by the developing device.

The developing device may employ either a dry developing method or a wet developing method. The developing device may be either a single-color developing device or a multi-color developing device.

Preferably, the developing device includes a stirrer to frictionally stir and charge the toner, a magnetic field generator fixed inside the developing device, and a rotatable developer bearer to bear on its surface a developer containing the toner.

Other Devices and Other Processes

Examples of the other optional devices include, but are not limited to, a transfer device, a fixing device, a cleaner, a neutralizer, a recycler, and a controller.

Examples of the other optional processes include, but are not limited to, a transfer process, a fixing process, a cleaning process, a neutralization process, a recycle process, and a control process.

Transfer Device and Transfer Process

The transfer device has no limits so long as it can transfer the visible image onto a recording medium. Preferably, the transfer device includes: a primary transfer device to transfer the visible image onto an intermediate transfer medium to form a composite transfer image, and a secondary transfer device to transfer the composite transfer image onto a recording medium.

The transfer process has no limits so long as the visible image can be transferred onto a recording medium. Preferably, the transfer process includes primarily transferring the visible image on an intermediate transfer medium and secondarily transferring the visible image onto a recording medium.

Fixing Process and Fixing Device

The fixing device has no limits so long as it can fix the transferred visible image on the recording medium. Preferably, the fixing device includes a heat-pressure member. Specific examples of the heat-pressure member include, but are not limited to: a combination of a heat roller and a pressure roller; and a combination of a heat roller, a pressure roller, and an endless belt.

The fixing process has no limits so long as the visible image transferred onto the recording medium can be fixed thereon. The fixing process may be performed either every time, each color toner is transferred onto the recording medium or at once after all color toners are laminated on one another.

Figure 2:
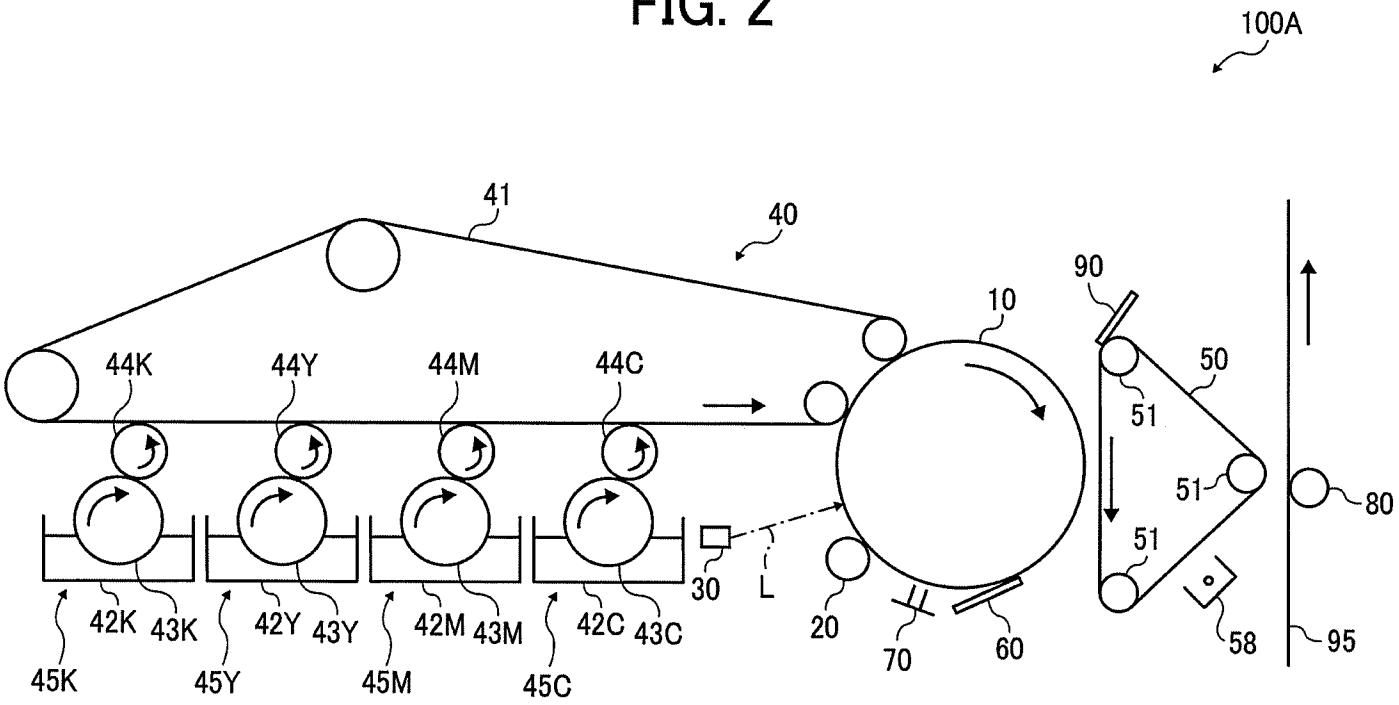
FIG. 2 is a schematic view of an image forming apparatus according to an embodiment of the present invention.

An image forming apparatus and according to an embodiment of the present invention is described below with reference to FIG. 2. A full-color image forming apparatus 100A includes a photoconductor drum 10 (hereinafter may be referred to as "photoconductor 10") serving as the electrostatic latent image bearer, a charging roller 20 serving as the charger, an irradiator 30 serving as the irradiator, a developing device 40 serving as the developing device, an intermediate transfer medium 50, a cleaner 60 equipped with a cleaning blade serving as the cleaner, and a neutralization lamp 70 serving as the neutralizer.

The intermediate transfer medium 50 is in the form of an endless belt and is stretched taut by three rollers 51 disposed inside the loop of the endless belt. The intermediate transfer medium 50 is movable in the direction indicated by arrow in FIG. 2. One or two of the three rollers 51 also function(s) as transfer bias roller(s) for applying a predetermined transfer bias (primary transfer bias) to the intermediate transfer medium 50. In the vicinity of the intermediate transfer medium 50, a cleaner 90 equipped with a cleaning blade is disposed. A transfer roller 80, serving as the transfer device, that applies a transfer bias to a transfer sheet 95 for secondarily transferring a toner image thereon is disposed facing the intermediate transfer medium 50. Around the intermediate transfer medium 50, a corona charger 58 that gives charge to the toner image on the intermediate transfer medium 50 is disposed between the contact point of the intermediate transfer medium 50 with the photoconductor 10 and the contact point of the intermediate transfer medium 50 with the transfer sheet 95 relative to the direction of rotation of the intermediate transfer medium 50.

The developing device 40 includes a developing belt 41; and a black developing unit 45K, a yellow developing unit 45Y, a magenta developing unit 45M, and a cyan developing unit 45C each disposed around the developing belt 41. The black developing unit 45K includes a developer container 42K, a developer supply roller 43K, and a developing roller 44K. The yellow developing unit 45Y includes a developer container 42Y, a developer supply roller 43Y, and a developing roller 44Y. The magenta developing unit 45M includes a developer container 42M, a developer supply roller 43M, and a developing roller 44M. The cyan developing unit 45C includes a developer container 42C, a developer supply roller 43C, and a developing roller 44C. The developing belt 41 is in the form of an endless belt and stretched taut by multiple belt rollers. A part of the developing belt 41 is in contact with the photoconductor 10.

In the image forming apparatus 100A, the charging roller 20 uniformly charges the photoconductor drum 10. The irradiator 30 irradiates the photoconductor drum 10 with light L containing image information to form an electrostatic latent image thereon. The developing device 40 supplies toner to the electrostatic latent image formed on the photoconductor drum 10 to form a toner image. The toner image is primarily transferred onto the intermediate transfer medium 50 by a voltage applied from the roller 51 and secondarily transferred onto the transfer sheet 95. Thus, a transfer image is formed on the transfer sheet 95. Residual toner particles remaining on the photoconductor 10 are removed by the cleaner 60. The charge of the photoconductor 10 is once eliminated by the neutralization lamp 70.

Figure 3:
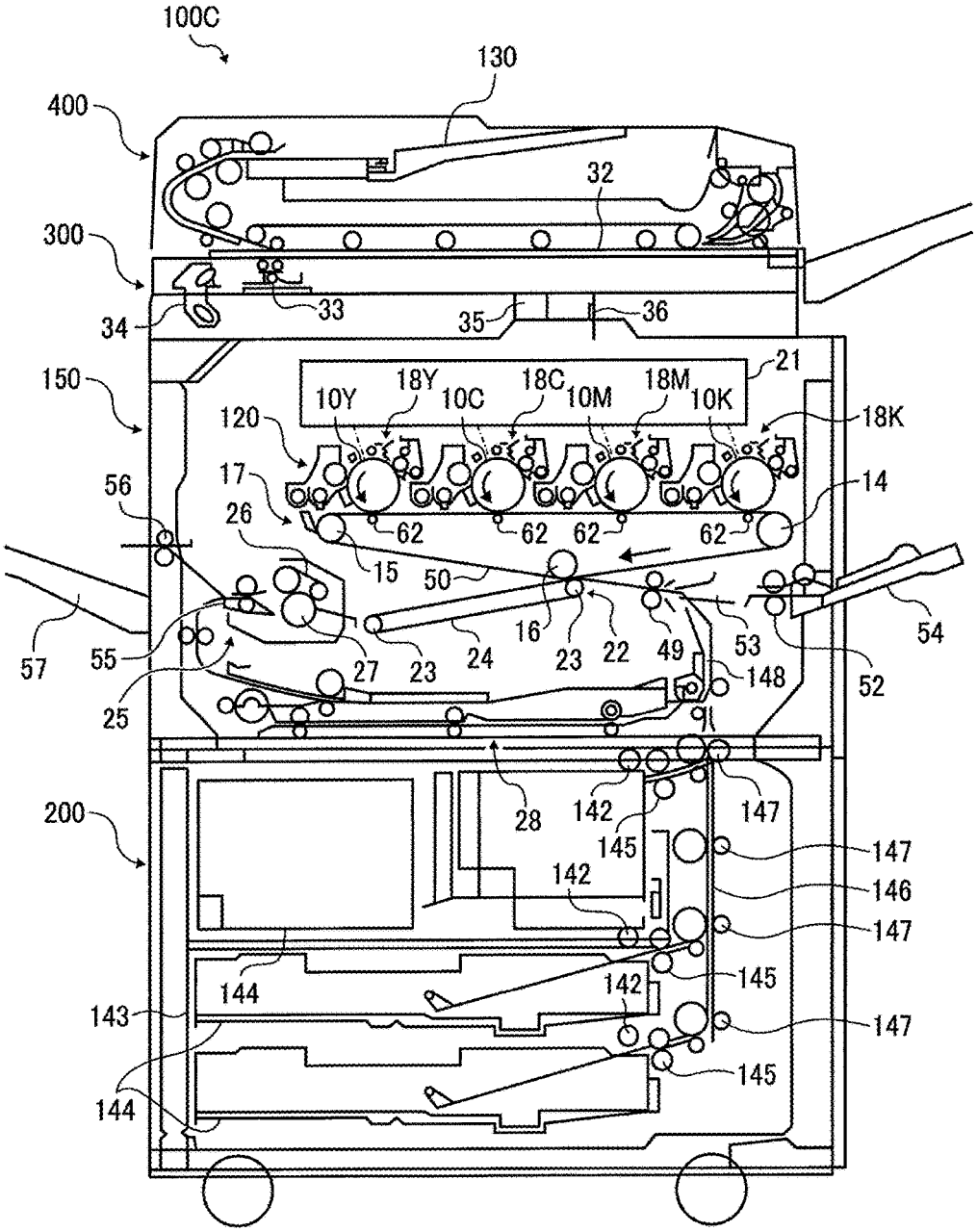
FIG. 3 is a schematic view of an image forming apparatus according to an embodiment of the present invention.

FIG. 3 is a schematic view of an image forming apparatus according to another embodiment of the invention. An image forming apparatus 100C illustrated in FIG. 3 includes a copier main body 150, a sheet feed table 200, a scanner 300, and an automatic document feeder (ADF) 400.

In the central part of the copier main body 150, an intermediate transfer medium 50 in the form of an endless belt is disposed. The intermediate transfer medium 50 is stretched taut with support rollers 14, 15, and 16 and rotatable clockwise in FIG. 3. In the vicinity of the support roller 15, an intermediate transfer medium cleaner 17 is disposed for removing residual toner particles remaining on the intermediate transfer medium 50. Four image forming units 18Y, 18C, 18M, and 18K (hereinafter collectively "image forming units 18") for forming yellow, cyan, magenta, and black images, respectively, are arranged in tandem facing a part of the intermediate transfer medium 50 stretched between the support rollers 14 and 15, thus forming a tandem developing device 120. In the vicinity of the tandem developing device 120, an irradiator 21 serving as the irradiator is disposed. A secondary transfer device 22 is disposed on the opposite side of the tandem developing device 120 relative to the intermediate transfer medium 50. The secondary transfer device 22 includes a secondary transfer belt 24 in the form of an endless belt stretched taut with a pair of rollers 23. A transfer sheet conveyed on the secondary transfer belt 24 and the intermediate transfer medium 50 can contact with each other. In the vicinity of the secondary transfer device 22, a fixing device 25 serving as the fixing device is disposed. The fixing device 25 includes a fixing belt 26 in the form of an endless belt and a pressing roller 27 pressed against the fixing belt 26.

In the vicinity of the secondary transfer device 22 and the fixing device 25, a sheet reversing device 28 is disposed for reversing the transfer sheet so that images can be formed on both surfaces of the transfer sheet.

A procedure for forming a full-color image (color copy) with the tandem developing device 120 is described below. First, a document is set on a document table 130 of the automatic document feeder 400. Alternatively, a document is set on a contact glass 32 of the scanner 300 while the automatic document feeder 400 is lifted up, followed by holding down of the automatic document feeder 400.

As a switch is pressed, in a case in which a document is set on the contact glass 32, the scanner 300 immediately starts driving. In a case in which a document is set on the automatic document feeder 400, the scanner 300 starts driving after the document is moved onto the contact glass 32. A first moving body 33 and a second moving body 34 start moving thereafter. The first moving body 33 directs light emitted from a light source to the document. A mirror carried by the second moving body 34 reflects light reflected from the document toward a reading sensor 36 through an imaging lens 35. Thus, the document is read by the reading sensor 36 and converted into image information of black, magenta, cyan, and yellow.

The image information of yellow, cyan, magenta, and black are respectively transmitted to the image forming units 18Y, 18C, 18M, and 18K in the tandem developing device 120. The image forming units 18Y, 18C, 18M, and 18K form respective toner images of yellow, cyan, magenta, and black. The image forming units 18Y, 18C, 18M, and 18K include respective electrostatic latent image bearers 10Y, 10C, 10M, and 10K. Further, each of the image forming units 18 includes a charger to uniformly charge each electrostatic latent image bearer 10, an irradiator to irradiate each electrostatic latent image bearer 10 with light based on the color image information to form an electrostatic latent image thereon, a developing device to develop the electrostatic latent image with each toner (black toner, yellow toner, magenta toner, or cyan toner) to form a toner image, a transfer charger 62 to transfer the toner image onto the intermediate transfer medium 50, a cleaner, and a neutralizer. The image forming units 18Y, 18C, 18M, and 18K form respective toner images of yellow, cyan, magenta, and black. The toner images of yellow, cyan, magenta, and black are primarily transferred from the respective electrostatic latent image bearers 10Y, 10C, 10M, and 10K in a sequential manner onto the intermediate transfer medium 50 that is rotated by the support rollers 14, 15, and 16. Thus, the toner images of yellow, cyan, magenta, and black are superimposed on one another on the intermediate transfer medium 50, thus forming a composite full-color toner image.

At the same time, in the sheet feed table 200, one of sheet feed rollers 142 starts rotating to feed sheets of recording paper from one of sheet feed cassettes 144 in a sheet bank 143. One of separation rollers 145 separates the sheets one by one and feeds them to a sheet feed path 146. Feed rollers 147 feed each sheet to a sheet feed path 148 in the copier main body 150. The sheet is stopped by striking a registration roller 49. Alternatively, sheets may be fed from a manual feed tray 54. In this case, a separation roller 52 separates the sheets one by one and feeds it to a manual sheet feed path 53. The sheet is stopped by striking the registration roller 49. The registration roller 49 is generally grounded. Alternatively, the registration roller 49 may be applied with a bias for the purpose of removing paper powders from the sheet. The registration roller 49 starts rotating to feed the sheet to between the intermediate transfer medium 50 and the secondary transfer device 22 in synchronization with an entry of the composite full-color toner image formed on the intermediate transfer medium 50 thereto. The secondary transfer device 22 secondarily transfers the composite full-color toner image onto the sheet. Thus, the composite full-color image is formed on the sheet. After the composite full-color image is transferred, residual toner particles remaining on the intermediate transfer medium 50 are removed by the intermediate transfer medium cleaner 17.

The sheet having the composite full-color toner image thereon is fed from the secondary transfer device 22 to the fixing device 25. The fixing device 25 fixes the composite full-color toner image on the sheet by application of heat and pressure. A switch claw 55 switches sheet feed paths so that the sheet is ejected by an ejection roller 56 and stacked on a sheet ejection tray 57. Alternatively, the switch claw 55 may switch sheet feed paths so that the sheet is introduced into the sheet reversing device 28 and gets reversed. The sheet is then introduced to the transfer position again so that another image is recorded on the back side of the sheet. Thereafter, the sheet is ejected by the ejection roller 56 and stacked on the sheet ejection tray 57.

EXAMPLES

The present invention is described in detail with reference to the Examples but not limited to the following Examples. "Parts" represents parts by mass and "% (percent)" represents percent by mass unless otherwise specified in the following description.

The values described in the following Examples were measured by the above-described methods. Properties (e.g., Tg, Tm, molecular weight) of the amorphous resin, the crystalline resin, etc., were measured from the single bodies thereof.

Preparation of Amorphous Polyester Resins A

Synthesis of Amorphous Polyester Resin A-1

In a four-neck flask equipped with a nitrogen inlet tube, a dewatering tube, a stirrer, and a thermocouple, alcohol components including ethylene oxide 2-mol adduct of bisphenol A (BisA-EO), propylene oxide 3-mol adduct of bisphenol A (BisA-PO), and trimethylolpropane (TMP) at a molar ratio (BisA-EO/BisA-PO/TMP) of 38.6/57.9/3.5 and acid components including terephthalic acid and adipic acid at a molar ratio (terephthalic acid/adipic acid) of 85/15 were contained, such that the molar ratio (OH/COOH) of hydroxy groups to carboxyl groups became 1.12. After adding 500 ppm of titanium tetraisopropoxide (based on the resin components) to the flask, the flask contents were allowed to react at 230° C. at normal pressures for 8 hours, and subsequently at reduced pressures of 10 to 15 mmHg for 4 hours. After further adding 1% by mol of trimellitic anhydride (based on all the resin components) to the flask, the flask contents were allowed to react at 180° C. at normal pressures for 3 hours. Thus, an amorphous polyester resin A-1 was prepared. Properties thereof are presented in Table 1.

Synthesis of Amorphous Polyester Resin A-2

The procedure for preparing the amorphous polyester resin A-1 was repeated except for changing the acid components, the alcohol components, the ratio OH/COOH, and the type and amount of branching component as described in Table 1. Thus, an amorphous polyester resin A-2 was prepared. Properties thereof are presented in Table 1.

In Table 1, the amount of branching component refers to the molar percent of aliphatic alcohols having 3 or more valences to the alcohol components. In Table 1, "BisA-EO" and "BisA-PO" respectively represent ethylene oxide 2-mol adduct of bisphenol and propylene oxide 3-mol adduct of bisphenol A.

TABLE 1

| | A-1 | A-2 |
|---|---|---|
| Dicarboxylic Acid | Terephthalic Acid 85%/ Adipic Acid 15% | Terephthalic Acid 80%/ Adipic Acid 20% |
| Diol | BisA-EO 38.6%/ BisA-PO 57.9% | BisA-EO 0%/ BisA-PO 100% |
| Branching Component | Trimethylolpropane (TMP) | Trimethylolpropane (TMP) |
| Amount of Branching Component | 3.5 | 3.5 |
| OH/COOH | 1.12 | 1.12 |
| Tg | 61 | 61 |
| Mw | 13,000 | 13,000 |
| SP | 11.04 | 10.88 |

Synthesis of Ketimine

In a reaction vessel equipped with a stirrer and a thermometer, 170 parts of isophoronediamine and 75 parts of methyl ethyl ketone were contained and allowed to react at 50° C. for 5 hours. Thus, a ketimine compound 1 was prepared.

The ketimine compound 1 had an amine value of 418.

Preparation of Prepolymer B

Synthesis of Non-Linear Amorphous Polyester Resin B-1 (Prepolymer B-1) Having Reactive Group In a reaction vessel equipped with a cooling tube, a stirrer, and a nitrogen inlet tube, alcohol components including 97% by mol of 3-methyl-1,5-pentanediol and 3% by mol of trimethylolpropane (TMP) and acid components including 50% by mol of adipic acid and 50% by mol of terephthalic acid were contained, such that the molar ratio (OH/COOH) of hydroxyl groups to carboxyl groups became 1.1. Further, 300 ppm of titanium tetraisopropoxide (based on the resin components) was added to the vessel. The flask contents were heated to 200° C. over a period of about 4 hours, thereafter heated to 230° C. over a period of 2 hours, and allowed to react until no water flowed out. The flask contents were further allowed to react at reduced pressures of 10 to 15 mmHg for 5 hours. Thus, an intermediate polyester B-1 was prepared.

Next, in a reaction vessel equipped with a cooling tube, a stirrer, and a nitrogen inlet tube, the intermediate polyester B-1 and isophorone diisocyanate (IPDI) were contained, such that the molar ratio of isocyanate groups in IPDI to hydroxyl groups in the intermediate polyester became 2.1. The flask contents were diluted with ethyl acetate to become a 48% ethyl acetate solution and allowed to react at 100° C. for 5 hours. Thus, a non-linear amorphous polyester resin B-1 (prepolymer B-1) having a reactive group was prepared. The non-linear amorphous polyester resin B-1 had a number average molecular weight (Mn) of 5,800, a weight average molecular weight (Mw) of 26,000, and a Tg of −5° C.

Preparation of Crystalline Polyester Resin C

Synthesis of Crystalline Polyester Resin C-1

A 5-L four-neck flask equipped with a nitrogen inlet tube, a dewatering tube, a stirrer, and a thermocouple, sebacic acid and ethylene glycol were contained, such that the molar ratio (OH/COOH) of hydroxyl groups to carboxyl groups became 0.85. After adding 500 ppm of titanium tetraisopropoxide (based on the resin components) to the flask, the flask contents were allowed to react at 180° C. for 10 hours, thereafter at 200° C. for 3 hours, and further under a pressure of 8.3 kPa for 2 hours. Thus, a crystalline polyester resin C-1 was prepared. Properties thereof are presented in Table 2.

Synthesis of Crystalline Polyester Resins C-2 and C-3

The procedure for preparing the crystalline polyester resin C-1 was repeated except for changing the acid components, the alcohol components, and the ratio OH/COOH as described in Table 2. Thus, crystalline polyester resins C-2 and C-3 were prepared. Properties thereof are presented in Table 2.

TABLE 2

| | C-1 | C-2 | C-3 |
|---|---|---|---|
| Dicarboxylic Acid | Sebacic Acid 100% | Sebacic Acid 100% | Hexadecane Dioic Acid |
| Diol | Ethylene Glycol 100% | Hexanediol 100% | Hexanediol 100% |
| OH/COOH | 0.85 | 0.85 | 0.9 |
| Tm | 70 | 65 | 81 |
| Mw | 17,000 | 16,000 | 30,000 |

Preparation of Amorphous Hybrid Resin

Synthesis of Amorphous Hybrid Resin

A 5-L four-neck flask equipped with a nitrogen inlet tube, a dewatering tube, a stirrer, and a thermocouple was charged with 7.2 g of 2,3-butanediol, 6.08 g of 1,2-propanediol, 18.59 g of terephthalic acid, and 0.18 g of tin (II) 2-ethylhexanoate. After filling the flask with inert atmosphere by introducing nitrogen gas, the flask was heated and maintained at 180° C. for 1 hour, thereafter heated from 180° C. to 230° C. at a temperature rising rate of 10° C./hr, subjected to a condensation polymerization reaction at 230° C. for 10 hours, and further allowed to react at 230° C. at a pressure of 8.0 kPa for 1 hour. After cooling the flask to 160° C., 0.6 g of acrylic acid, 7.79 g of styrene, 1.48 g of 2-ethylhexyl acrylate, and dibutyl peroxide were dropped in the flask over a period of 1 hour. After the dropping was completed, the flask contents were aged by an addition polymerization reaction for 1 hour while maintaining the temperature at 160° C. and thereafter heated to 210° C. Further, 4.61 g of trimellitic anhydride was added to the flask, and the flask contents were allowed to react at 210° C. for 2 hours and subsequently at 210° C. at a pressure of 10 kPa until the reaction product reached a desired softening point. Thus, an amorphous hybrid resin was prepared.

The amorphous hybrid resin had a weight average molecular weight of 55,000, a number average molecular weight of 2,800, a Tg of 55° C., an acid value of 9.4 mgKOH/g.

Example 1

Preparation of Master Batch

First, 1,200 parts of water, 500 parts of a carbon black (PRINTEX 35 available from Degussa, having a DBP oil absorption of 42 mL/100 mg and a pH of 9.5), and 500 parts of the first amorphous polyester resin A-1 were mixed with a HENSCHEL MIXER (available from NIPPON COKE & ENGINEERING CO., LID.). The mixture was kneaded with a double roll at 150° C. for 30 minutes, thereafter rolled to cool, and pulverized with a pulverizer. Thus, a master batch 1 was prepared.

Preparation of Dispersion Liquid 1 of Composite Particle of Crystalline Polyester Resin and Release Agent In a vessel equipped with a stirrer and a thermometer, 190 parts of a paraffin wax (HNP-9 available from NIPPON SEIRO CO., LTD., a hydrocarbon wax having a melting point of 75° C. and a crystallization start temperature of 63° C.), serving as a release agent, 319 parts of the crystalline polyester resin C-1, and 3,190 parts of ethyl acetate were contained and heated to 80° C. while being stirred, and maintained for 30 minutes. Thus, a solution was prepared. The solution was cooled from the crystallization start temperature of the release agent at a cooing rate 1 of 30° C./min, and from the crystallization start temperature of the crystalline polyester resin C-1 to 18° C. at a cooling rate 2 of 0.5° C./min. The solution was thereafter subjected to a dispersion treatment using a bead mill (ULTRAVISCOMILL available from Aimex Co., Ltd.) filled with 80% by volume of zirconia beads having a diameter of 0.5 mm, at a liquid feeding speed of 1 kg/hour and a disc peripheral speed of 6 m/sec. Thus, a composite particle dispersion liquid 1 was prepared. The composite particles in the composite particle dispersion liquid 1 had a volume average particle diameter of 0.54 μm when measured by LA-920 (available from HORIBA, Ltd.).

Preparation of Oily Phase

In a vessel, 962 parts of the composite particle dispersion liquid 1, 647 parts of the amorphous polyester resin A-1, and 100 parts of the master batch 1 were mixed with a TK HOMOMIXER (available from PRIMIX Corporation) at a revolution of 7,000 rpm for 60 minutes. Thus, an oily phase 1 was prepared.

Preparation of Fine Particle Dispersion Liquid

In a reaction vessel equipped with a stirrer and a thermometer, 683 parts of water, 11 parts of a sodium salt of a sulfate of ethylene oxide adduct of methacrylic acid (ELEMINOL RS-30 available from Sanyo Chemical Industries, Ltd.), 138 parts of styrene, 138 parts of methacrylic acid, and 1 part of ammonium persulfate were contained and stirred at a revolution of 400 rpm for 15 minutes. Thus, a white emulsion was obtained. The white emulsion was heated to 75° C. and subjected to a reaction for 5 hours. A 1% aqueous solution of ammonium persulfate in an amount of 30 parts was further added to the emulsion, and the mixture was aged at 75° C. for 5 hours. Thus, a fine particle dispersion liquid 1 was prepared, that was an aqueous dispersion of a vinyl resin (i.e., a copolymer of styrene, methacrylic acid, and a sodium salt of a sulfate of ethylene oxide adduct of methacrylic acid).

The fine particles in the fine particle dispersion liquid 1 had a volume average particle diameter of 0.14 μm when measured by LA-920 (available from HORIBA, Ltd.). A part of the fine particle dispersion liquid 1 was dried to isolate the resin.

Preparation of Aqueous Phase

An aqueous phase 1 was prepared by stir-mixing 990 parts of water, 83 parts of the fine particle dispersion liquid 1, 37 parts of a 48.5% aqueous solution of sodium dodecyl diphenyl ether disulfonate (ELEMINOL MON-7 available from Sanyo Chemical Industries, Ltd.), and 90 parts of ethyl acetate. The aqueous phase 1 was a milky white liquid.

Emulsification and Solvent Removal

In the vessel containing the oily phase 1, 1,700 parts of the aqueous phase 1 was added and mixed with a TK HOMOMIXER at a revolution of 8,000 rpm for 20 minutes. Thus, an emulsion slurry 1 was prepared.

The emulsion slurry 1 was contained in a vessel equipped with a stirrer and a thermometer and subjected to solvent removal at 30° C. for 8 hours and subsequently to aging at 45° C. for 4 hours. Thus, a dispersion slurry 1 was obtained.

Washing and Drying

After 100 parts of the dispersion slurry 1 was filtered under reduced pressures, (1) 100 parts of ion-exchange water was added to the filter cake and mixed therewith using a TK HOMOMIXER at a revolution of 12,000 rpm for 10 minutes, followed by filtration; (2) 100 parts of a 10% aqueous solution of sodium hydroxide was added to the filter cake of (1) and mixed therewith using a TK HOMOMIXER at a revolution of 12,000 rpm for 30 minutes, followed by filtration under reduced pressures; (3) 100 parts of a 10% aqueous solution of hydrochloric was added to the filter cake of (2) and mixed therewith using a TK HOMOMIXER at a revolution of 12,000 rpm for 10 minutes, followed by filtration; and (4) 300 parts of ion-exchange water was added to the filter cake of (3) and mixed therewith using a TK HOMOMIXER at a revolution of 12,000 rpm for 10 minutes, followed by filtration. These operations (1) to (4) were repeated twice, thus obtaining a filter cake 1.

The filter cake 1 was dried by a circulating air dryer at 45° C. for 48 hours and then filtered with a mesh having an opening of 75 μm. Thus, a toner 1 was prepared.

Compositional ratio and properties of the toner 1 are presented in Table 3-1. Compositional ratio and properties of the toners prepared in the following Examples and Comparative Examples are presented in Tables 3-1 to 3-3.

In Tables 3-1 to 3-3, "Compositional Ratio" (% by mass) is based on the total mass of the amorphous polyester resin A, the prepolymer B that is a reactive precursor of the amorphous polyester resin B, the crystalline polyester resin C, the amorphous hybrid resin, the release agent, and the colorant.

Evaluations

Developers were prepared in the following manner and subjected to the following evaluations. The evaluation results are presented in Tables 3-1 to 3-3.

Preparation of Developer

Preparation of Carrier

A resin layer coating liquid was prepared by dispersing 100 parts of a silicone resin (organo straight silicone), 5 parts of γ-(2-aminoethyl) aminopropyl trimethoxysilane, and 10 parts of a carbon black in 100 parts of toluene by a homomixer for 20 minutes. The resin layer coating liquid was applied to the surfaces of 1,000 parts of spherical magnetite having an average particle diameter of 50 μm by a fluidized bed coating device. Thus, a carrier was prepared.

Preparation of Developer

The toner 1 in an amount of 5 parts and the carrier in an amount of 95 parts were mixed. Thus, a developer 1 was prepared. In the following Examples 2-8, developers 2-8 were prepared in the same manner using toners 2-8, respectively. In the following Comparative Examples 1-3, developers 9-11 were prepared in the same manner using toners 9-11, respectively.

Low-Temperature Fixability and High-Temperature Offset Resistance

A copy test was performed by a copier IMAGIO MF2200 (available from Ricoh Co., Ltd.) employing a TEFLON® roller as the fixing roller, the fixing unit of which had been modified, using a paper TYPE 6200 (available from Ricoh Co., Ltd.).

In the test, the cold offset temperature (lower-limit fixable temperature) and the high-temperature offset temperature (upper-limit fixable temperature) were determined by varying the fixing temperature.

The lower-limit fixable temperature was evaluated while setting the sheet feed linear speed to 120 to 150 mm/sec, the surface pressure to 1.2 kgf/cm$^2$, and the nip width to 3 mm.

The upper-limit fixable temperature was evaluated while setting the sheet feed linear speed to 50 mm/sec, the surface pressure to 2.0 kgf/cm$^2$, and the nip width to 4.5 mm.

Heat-Resistant Storage Stability

Each toner was stored at 50° C. for 8 hours and thereafter sieved with a 42 mesh for 2 minutes. The residual rate of toner particles remaining on the mesh was measured. The smaller the residual rate, the better the heat-resistant storage stability.

Heat-resistant storage stability was evaluated based on the following criteria.

Evaluation Criteria

A: The residual rate was less than 10%.

B: The residual rate was less than 20% but not less than 10%.

C: The residual rate was less than 30% but not less than 20%.

D: The residual rate was not less than 30%.

High-Temperature High-Humidity Storage Stability

Each toner in an amount of 5 g was stored in an environment at 40° C. and 70% RH for 2 weeks and thereafter sieved with a mesh having an opening of 106 μm. The amount of the residual toner particles remaining on the mesh was measured and evaluated based on the following criteria.

Evaluation Criteria

A: The amount of toner particles remaining on the mesh was 0 mg.

B: The amount of toner particles remaining on the mesh was more than 0 mg but less than 2 mg.

C: The amount of toner particles remaining on the mesh was 2 mg or more but less than 50 mg.

D: The amount of toner particles remaining on the mesh was 50 mg or more.

White Voids Caused in Image Transfer

Each developer was set in an image forming apparatus IMAGIO MP C2802 (available from Ricoh Co., Ltd.). A printing test was performed in which an A4-size chart having an image area rate of 5% was continuously printed on 10,000 sheets. After completion of the test, an overall solid image (with a toner deposition amount of 0.4 mg/cm$^2$) was printed on three A4-size sheets. The printed images were visually observed to determine the number of white voids appeared in each images.

The total number of white voids in the three sheets was determined and ranked as follows.

Ranks

A: No white void was visually observed in each of the three sheets.

B: White voids were observed with an optical microscope in the third sheet. No problem may be caused in practical use.

C: One to ten white voids were visually observed in the three sheets in total. A problem may be caused in practical use.

D: More than ten voids were visually observed in the three sheets in total. A significant problem may be caused in practical use.

Deterioration Charging

Each toner in an amount of 0.25 g and a carrier in an amount of 4.75 g were contained in a stainless steel container with a bottom diameter of 25 mm and a height of 30 mm. The container was rotated in a circumferential direction at 300 rpm for 20 minutes so that the toner and the carrier were stirred and brought into contact with each other. The carrier was composed of ferrite particles having an average particle diameter of 35 μm (available from Ricoh Co., Ltd.).

The stirred toner was subjected to a measurement of charge quantity per unit area (Q/S) by a blow-off method using a charge measurement device TB-200 (available from TOSHIBA CORPORATION).

Specifically, the sample container of the charge measurement device, equipped with a 400-mesh stainless steel screen, was filled with a sample, and the sample was blown off with a nitrogen gas with a blow pressure of 50 kPa (0.5 kgf/cm$^2$) for 10 seconds in a normal-temperature normal-humidity condition (20° C., 55% RH).

Evaluation Criteria

A: The absolute charge amount was 200 μC/m$^2$ or more and less than 250 μC/m$^2$.

B: The absolute charge amount was 150 μC/m$^2$ or more and less than 200 μC/m$^2$.

C: The absolute charge amount was 100 μC/m$^2$ or more and less than 150 μC/m$^2$.

D: The absolute charge amount was 150 μC/m$^2$ or more.

Example 2

The procedure in Example 1 was repeated except for changing the cooling rate 1 and the cooling rate 2 to 20° C./min and 2° C./min, respectively. Thus, a toner 2 was prepared. Compositional ratio and properties of the toner 2 are presented in Table 3-1.

A developer 2 using the toner 2 was prepared and evaluated in the same manner as in Example 1. The evaluation results are presented in Table 3-1.

Example 3

The procedure in Example 1 was repeated except for changing the cooling rate 1 and the cooling rate 2 to 1° C./min and 10° C./min, respectively. Thus, a toner 3 was prepared. Compositional ratio and properties of the toner 3 are presented in Table 3-1.

A developer 3 using the toner 3 was prepared and evaluated in the same manner as in Example 1. The evaluation results are presented in Table 3-1.

Example 4

The procedure in Example 1 was repeated except for replacing the crystalline resin C-1 with the crystalline resin C-3. Thus, a toner 4 was prepared. Compositional ratio and properties of the toner 4 are presented in Table 3-1.

A developer 4 using the toner 4 was prepared and evaluated in the same manner as in Example 1. The evaluation results are presented in Table 3-1.

Example 5

The procedure in Example 1 was repeated except for adding the amorphous hybrid resin to raw materials and changing the compositional ratio of raw materials as described in Table 3-2. Compositional ratio and properties of the toner 5 are presented in Table 3-2.

A developer 5 using the toner 5 was prepared and evaluated in the same manner as in Example 1. The evaluation results are presented in Table 3-2.

Example 6

The procedure in Example 1 was repeated except for replacing the crystalline resin C-1 with the crystalline resin C-2. Thus, a toner 6 was prepared. Compositional ratio and properties of the toner 6 are presented in Table 3-2.

A developer 6 using the toner 6 was prepared and evaluated in the same manner as in Example 1. The evaluation results are presented in Table 3-2.

Example 7

The procedure in Example 1 was repeated except for changing the cooling rate and raw materials as described in Table 3-2.

In addition, the procedure in "Preparation of Oily Phase" was changed such that the composite particle dispersion liquid 1, the amorphous polyester resin A-1, the master batch 1, and the prepolymer B-1 were mixed to prepare an oily phase, and ketimine in an amount corresponding to 102% of the NCO value of the prepolymer was added to the oily phase to cause an urethane forming reaction and elongate the prepolymer B. Thus, a toner 7 was prepared.

Compositional ratio and properties of the toner 7 are presented in Table 3-2.

A developer 7 using the toner 7 was prepared and evaluated in the same manner as in Example 1. The evaluation results are presented in Table 3-2.

The toner 7 was including 6.7% by mass of THF-insoluble matter. As a result of an NMR analysis, it was confirmed that the THF insoluble matter was including 96.9% by mol of 3-methyl-1,5-pentanediol and 3.1% by mol of trimethylolpropane as alcohol components.

Example 8

The procedure in Example 7 was repeated except for changing the raw materials as described in Table 3-2. Thus, a toner 8 was prepared. Compositional ratio and properties of the toner 8 are presented in Table 3-2.

A developer 8 using the toner 8 was prepared and evaluated in the same manner as in Example 1. The evaluation results are presented in Table 3-2.

The toner 8 was including 6.5% by mass of THF-insoluble matter. As a result of an NMR analysis, it was confirmed that the THF insoluble matter was including 97.0% by mol of 3-methyl-1,5-pentanediol and 3.0% by mol of trimethylolpropane as alcohol components.

Comparative Example 1

Preparation of Wax Dispersion Liquid

In a vessel equipped with a stirrer and a thermometer, 300 parts of a paraffin wax (HNP-9 available from NIPPON SEIRO CO., LTD., a hydrocarbon wax having a melting point of 75° C.), serving as a release agent, 150 parts of a wax dispersant, and 1,800 parts of ethyl acetate were contained and heated to 80° C. while being stirred, maintained at 80° C. for 5 hours, and cooled to 30° C. over a period of 1 hour. The resulting liquid was thereafter subjected to a dispersion treatment using a bead mill (ULTRAVISCOMILL available from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Thus, a wax dispersion liquid 1 was prepared.

Preparation of Crystalline Polyester Resin Dispersion Liquid

In a vessel equipped with a stirrer and a thermometer, 308 parts of the crystalline polyester resin C-1 and 1,900 parts of ethyl acetate were contained and heated to 80° C. while being stirred, maintained at 80° C. for 5 hours, and cooled to 30° C. over a period of 1 hour. The resulting liquid was thereafter subjected to a dispersion treatment using a bead mill (ULTRAVISCOMILL available from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Thus, a crystalline polyester resin dispersion liquid 1 was prepared.

Preparation of Oily Phase

In a vessel, 373 parts of the wax dispersion liquid 1, 592 parts of the crystalline polyester resin dispersion liquid 1, 647 parts of the amorphous polyester resin A-1, and 100 parts of the master batch 1 were mixed with a TK HOMOMIXER (available from PRIMIX Corporation) at a revolution of 7,000 rpm for 60 minutes. Thus, an oily phase 9 was prepared.

The procedure in Example 1 was repeated except for changing the procedure for preparing the oily phase as described above. Thus, a toner 9 was prepared. Compositional ratio and properties of the toner 9 are presented in Table 3-3.

A developer 9 using the toner 9 was prepared and evaluated in the same manner as in Example 1. The evaluation results are presented in Table 3-3.

Comparative Example 2

The procedure in Comparative Example 1 was repeated except for adding the amorphous hybrid resin to raw materials and changing the compositional ratio of raw materials as described in Table 3-3. Thus, a toner 10 was prepared. Compositional ratio and properties of the toner 10 are presented in Table 3-3.

A developer 10 using the toner 10 was prepared and evaluated in the same manner as in Example 1. The evaluation results are presented in Table 3-3.

Comparative Example 3

The procedure in Comparative Example 2 was repeated except for replacing the crystalline polyester resin C-1 with the crystalline polyester resin C-2 and including the amorphous polyester resin B by reacting the prepolymer B with ketimine in the same manner as in Example 7. Thus, a toner 11 was prepared. Compositional ratio and properties of the toner 11 are presented in Table 3-3.

A developer 11 using the toner 11 was prepared and evaluated in the same manner as in Example 1. The evaluation results are presented in Table 3-3.

TABLE 3-1

| | | | Example 1 | Example 2 | Example 3 | Example 4 |
|---|---|---|---|---|---|---|
| Toner No. | | | 1 | 2 | 3 | 4 |
| Amorphous Polyester Resin A | | Type | A-1 | A-1 | A-1 | A-1 |
| | | Tg | 61 | 61 | 61 | 61 |
| | | Mw | 13,000 | 13,000 | 13,000 | 13,000 |
| | | SP | 11.04 | 11.04 | 11.04 | 11.04 |
| Prepolymer B | | Type | — | — | — | — |
| Crystalline Polyester Resin C | | Type | C-1 | C-1 | C-1 | C-3 |
| | | Tm | 70 | 70 | 70 | 81 |
| | | Mw | 17,000 | 17,000 | 17,000 | 30,000 |
| | | SP | 10.24 | 10.24 | 10.24 | 9.71 |
| | | Crystallization Temp. | 32 | 32 | 32 | 45 |
| Release Agent | | Type | D-1 | D-1 | D-1 | D-1 |
| | | Crystallization Temp. | 63 | 63 | 63 | 63 |
| Compositional Ratio | Amorphous Polyester Resin | | 78 | 78 | 78 | 78 |
| | Prepolymer | | 0 | 0 | 0 | 0 |
| | Crystalline Polyester Resin | | 10 | 10 | 10 | 10 |
| | Amorphous Hybrid Resin | | — | — | — | — |
| | Release Agent | | 6 | 6 | 6 | 6 |
| | Colorant | | 6 | 6 | 6 | 6 |
| Process Conditions | Cooling Rate 1 | | 30 | 20 | 1 | 30 |
| | Cooling Rate 2 | | 0.5 | 2 | 10 | 0.5 |
| Crystallization Temp. Difference between Release Agent and Crystalline Resin | | | 31 | 31 | 31 | 18 |
| SP Difference between Amorphous Resin and Crystalline Resin | | | 0.8 | 0.8 | 0.8 | 1.3 |
| Toner Properties | Toner Tg 1st | | 55 | 55 | 55 | 60 |
| | B/A | | 0.20 | 0.40 | 0.70 | 0.79 |
| | D/C | | 0.40 | 0.55 | 0.65 | 0.45 |
| Toner Qualities | Fixing | Lower Limit | 110 | 105 | 100 | 100 |
| | | Upper Limit | 160 | 160 | 160 | 160 |
| | Heat-resistant Storage Stability | | A | A | B | A |
| | High-temperature High-humidity Storage Stability | | A | A | B | B |
| | White Voids | | B | B | B | B |
| | Deterioration Charging | | A | B | B | B |

TABLE 3-2

| | | | Example 5 | Example 6 | Example 7 | Example 8 |
|---|---|---|---|---|---|---|
| Toner No. | | | 5 | 6 | 7 | 8 |
| Amorphous Polyester Resin A | | Type | A-1 | A-1 | A-1 | A-2 |
| | | Tg | 61 | 61 | 61 | 61 |
| | | MW | 13,000 | 13,000 | 13,000 | 13,000 |
| | | SP | 11.04 | 11.04 | 11.04 | 10.88 |
| Prepolymer B | | Type | — | — | B-1 | B-1 |
| Crystalline Polyester Resin C | | Type | C-1 | C-2 | C-1 | C-2 |
| | | Tm | 70 | 65 | 70 | 65 |
| | | Mw | 17,000 | 16,000 | 17,000 | 16,000 |
| | | SP | 10.24 | 9.85 | 10.24 | 9.85 |
| | | Crystallization Temp. | 32 | 24 | 32 | 24 |
| Release Agent | | Type | D-1 | D-1 | D-1 | D-1 |
| | | Crystallization Temp. | 63 | 63 | 63 | 63 |
| Compositional Ratio | Amorphous Polyester Resin | | 68 | 78 | 59 | 59 |
| | Prepolymer | | 0 | 0 | 9 | 9 |
| | Crystalline Polyester Resin | | 10 | 10 | 10 | 10 |
| | Amorphous Hybrid Resin | | 10 | — | 10 | 10 |
| | Release Agent | | 6 | 6 | 6 | 6 |
| | Colorant | | 6 | 6 | 6 | 6 |
| Process Conditions | Cooling Rate 1 | | 30 | 30 | 20 | 20 |
| | Cooling Rate 2 | | 0.5 | 0.5 | 2 | 2 |

TABLE 3-2-continued

| | | | Example 5 | Example 6 | Example 7 | Example 8 |
|---|---|---|---|---|---|---|
| Crystallization Temp. Difference between Release Agent and Crystalline Resin | | | 31 | 39 | 31 | 39 |
| SP Difference between Amorphous Resin and Crystalline Resin | | | 0.8 | 1.2 | 0.8 | 1.0 |
| Toner Properties | Toner Tg 1st | | 55 | 57 | 48 | 47 |
| | B/A | | 0.15 | 0.65 | 0.59 | 0.51 |
| | D/C | | 0.30 | 0.75 | 0.30 | 0.13 |
| Toner Qualities | Fixing | Lower Limit | 110 | 100 | 100 | 100 |
| | | Upper Limit | 160 | 160 | 170 | 170 |
| | Heat-resistant Storage Stability | | A | B | A | A |
| | High-temperature High-humidity Storage Stability | | A | A | A | A |
| | White Voids | | A | B | A | A |
| | Deterioration Charging | | A | B | A | A |

TABLE 3-3

| | | | Comparative Example 1 | Comparative Example 2 | Comparative Example 3 |
|---|---|---|---|---|---|
| Toner No. | | | 9 | 10 | 11 |
| Amorphous Polyester Resin A | | Type | A-1 | A-1 | A-2 |
| | | Tg | 61 | 61 | 61 |
| | | Mw | 13,000 | 13,000 | 13,000 |
| | | SP | 11.04 | 11.04 | 10.88 |
| Prepolymer B | | Type | — | — | B-1 |
| Crystalline Polyester Resin C | | Type | C-1 | C-1 | C-2 |
| | | Tm | 70 | 70 | 65 |
| | | Mw | 17,000 | 17,000 | 16,000 |
| | | SP | 10.24 | 10.24 | 9.85 |
| | | Crystallization Temp. | 32 | 32 | 24 |
| Release Agent | | Type | D-1 | D-1 | D-1 |
| | | Crystallization Temp. | 63 | 63 | 63 |
| Compositional Ratio | Amorphous Polyester Resin | | 78 | 68 | 59 |
| | Prepolymer | | 0 | 0 | 9 |
| | Crystalline Polyester Resin | | 10 | 10 | 10 |
| | Amorphous Hybrid Resin | | — | 10 | 10 |
| | Release Agent | | 6 | 6 | 6 |
| | Colorant | | 6 | 6 | 6 |
| Process Conditions | Cooling Rate 1 | | — | — | — |
| | Cooling Rate 2 | | — | — | — |
| Crystallization Temp. Difference between Release Agent and Crystalline Resin | | | — | — | — |
| SP Difference between Amorphous Resin and Crystalline Resin | | | 0.8 | 0.8 | 1.0 |
| Toner Properties | Toner Tg 1st | | 55 | 55 | 47 |
| | B/A | | 0.86 | 0.80 | 0.83 |
| | D/C | | 0.60 | 0.35 | |
| Toner Qualities | Fixing | Lower Limit | 100 | 100 | 100 |
| | | Upper Limit | 160 | 160 | 170 |
| | Heat-resistant Storage Stability | | B | C | C |
| | High-temperature High-humidity Storage Stability | | C | C | D |
| | White Voids | | D | C | C |
| | Deterioration Charging | | D | C | D |

It is clear from the results presented in the above tables that the toners according to an embodiment of the present invention are excellent in heat-resistant storage stability and mechanical strength while maintaining low-temperature fixability and thereby demonstrate reliable charge property and image property.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A toner comprising:

an amorphous resin;

a crystalline resin dispersed in the amorphous resin; and a release agent, wherein the toner satisfies the following inequality:

$$B/A<0.8$$

where A represents a perimeter of the crystalline resin and B represents a length of a part of the perimeter A of the crystalline resin at which the crystalline resin is in contact with the amorphous resin, A and B being measured from a cross-sectional image of the toner observed with transmission electron microscope.

2. The toner of claim 1, wherein the release agent has a crystallization temperature higher than the crystalline resin by 20° C. or more.

3. The toner of claim 1, wherein the toner further satisfies the following inequality:

$$0.05<D/C<0.4$$

where C represents a perimeter of the toner and D represents a length of a part of the perimeter C of the toner at which the crystalline resin is exposed, C and D being measured from the cross-sectional image of the toner observed with transmission electron microscope.

4. The toner of claim 1, wherein the toner further satisfies an inequality $0.5<B/A\leq 0.6$.

5. The toner of claim 1, wherein the toner further satisfies the following inequality:

$$0.5<SP1-SP2<1.1$$

where SP1 and SP2 represent solubility parameters of the amorphous resin and the crystalline resin, respectively.

6. The toner of claim 1, further comprising:

an amorphous hybrid resin comprising:

a composite resin comprising:

a condensation polymerization resin unit; and a styrene resin unit, wherein the condensation polymerization resin unit and the styrene resin unit are partially chemically bonded to each other.

7. The toner of claim 1, wherein tetrahydrofuran-insoluble matter of the toner comprises:

a diol component comprising 50% by mol or more of an aliphatic diol having 3 to 10 carbon atoms based on 100% by mol of alcohol components; and a cross-linked component comprising an aliphatic alcohol having 3 or more valences, wherein the toner has a glass transition temperature (Tg1st) in the range of from 20° C. to 50° C. as measured in a first heating of differential scanning calorimetry.

8. A toner storage unit comprising:

a storage unit; and the toner of claim 1 stored in the storage unit.

9. An image forming apparatus comprising:

an electrostatic latent image bearer;

an electrostatic latent image forming device to form an electrostatic latent image on the electrostatic latent image bearer; and a developing device comprising the toner of claim 1, to develop the electrostatic latent image formed on the electrostatic latent image bearer into a visible image with the toner.

10. The toner of claim 1, wherein the toner is obtained by a process which comprises preparing a composite particle in which the crystalline resin and the release agent are partially combined by recrystallizing the crystalline resin and the release agent without a presence of the amorphous resin.

11. A method for manufacturing a toner, comprising:

dissolving a crystalline resin and a release agent in an organic solvent by application of heat to prepare a solution; and cooling the solution to prepare a dispersion liquid of a composite particle in which the crystalline resin and the release agent are partially combined by recrystallizing the crystalline resin and the release agent, wherein the dissolving and the cooling are conducted without a presence of an amorphous resin, and the release agent has a crystallization temperature higher than the crystalline resin by 20° C. or more.

12. The method of claim 11, wherein a cooling rate of the solution at a temperature below a crystallization temperature of the crystalline resin is smaller than a cooling rate of the solution at a temperature above the crystallization temperature of the crystalline resin.

* * * * *